US008543035B2

(12) United States Patent
Koishi

(10) Patent No.: US 8,543,035 B2
(45) Date of Patent: Sep. 24, 2013

(54) CLEANING DEVICE, CARTRIDGE AND IMAGE FORMING APPARATUS

(75) Inventor: Isao Koishi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 149 days.

(21) Appl. No.: 13/042,835

(22) Filed: Mar. 8, 2011

(65) Prior Publication Data

US 2011/0222906 A1 Sep. 15, 2011

(30) Foreign Application Priority Data

Mar. 15, 2010 (JP) ..... 2010-058416

(51) Int. Cl.
*G03G 15/00* (2006.01)
*G03G 21/00* (2006.01)

(52) U.S. Cl.
USPC ..... 399/117; 399/350; 399/351

(58) Field of Classification Search
USPC ..... 399/94, 98, 99, 117, 120
See application file for complete search history.

(56) References Cited

U.S. PATENT DOCUMENTS 6,246,849 B1 * 6/2001 Yokoyama et al. ..... 399/117
6,285,851 B1 9/2001 Kojima et al.
6,823,156 B2 11/2004 Okamoto
7,224,924 B2 5/2007 Okamoto
2003/0231907 A1 12/2003 Okamoto
2005/0180779 A1 8/2005 Okamoto
2010/0054807 A1 3/2010 Takeyama et al.

FOREIGN PATENT DOCUMENTS

CN 1176407 A 3/1998
CN 1655071 A 8/2005
EP 1345090 A2 9/2003
JP 2000-19930 A 1/2000

OTHER PUBLICATIONS

Notification of the First Office Action dated May 23, 2013, in Chinese Application No. 201110061295.

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A cleaning device for removing a developer remaining on an image bearing member from the image bearing member includes a cleaning device, including an elastic blade and a supporting member for supporting the elastic blade, for removing the developer remaining on the image bearing member from the image bearing member; an image bearing member bearing member including a supporting portion for rotatably supporting the image bearing member; and a removed developer accommodating container formed of a material having a thermal expansion coefficient different from that of a material for the supporting member. The image bearing member bearing member is fixed to the supporting member. The removed developer accommodating container is fixed to the supporting member. The image bearing member bearing member and the removed developer accommodating container are provided with a gap therebetween with respect to a longitudinal direction of the supporting member.

22 Claims, 22 Drawing Sheets

EMB. 3

EMB. 4

EMB. 5

EMB. 6

EMB. 7

EMB. 8

EMB. 9

CLEANING DEVICE, CARTRIDGE AND IMAGE FORMING APPARATUS

FIELD OF THE INVENTION AND RELATED ART

The present invention relates to a cleaning device for removing a developer from an image bearing member for use in an image forming apparatus. As the image forming apparatus, there is an electrophotographic image forming apparatus of an electrophotographic type such as a copying machine, a laser printer or a facsimile machine. Further, the present invention relates to a cartridge including such a cleaning device and relates to an image forming apparatus including the cartridge.

Here, in the present invention, the electrophotographic image forming apparatus forms an image on a recording material (e.g., paper, OHP sheet, etc.) by using an electrophotographic process. Examples of the electrophotographic image forming apparatus may include an electrophotographic copying machine, an electrophotographic printer (e.g., a laser beam printer, an LED printer, etc.), a facsimile machine, a word processor, and the like.

Further, the cartridge refers to a member constituted by integrally assembling members used for the image forming apparatus and is provided detachably mountable to the image forming apparatus. A process cartridge is a cartridge prepared by integrally assembling a charging means, a developing means or a cleaning means which are process means, and an electrophotographic photosensitive drum, and is detachably mountable to an electrophotographic image forming apparatus main assembly. The process cartridge is also a cartridge prepared by integrally assembling at least one of the charging means, the developing means and the cleaning means which are as the process means, and the electrophotographic photosensitive drum, and is detachably mountable to the electrophotographic image forming apparatus main assembly.

In the conventional electrophotographic image forming apparatus as described above, the electrophotographic photosensitive drum uniformly charged by the charging means is subjected to selective exposure to form an electrostatic latent image. Then, the electrostatic latent image is developed by the developing means into a visible image (developer image). Thereafter, the developer image is transferred onto recording paper (recording material) to be formed on the recording paper as an image. The electrophotographic photosensitive drum after being subjected to the developer image transfer is subjected to removal of developer remaining on a surface thereof by the cleaning means, and then goes to a subsequent image formation. Incidentally, the developer removed from the electrophotographic photosensitive drum surface by the cleaning means is accommodated in a removed developer accommodating container.

As a cleaning device constituting the cleaning means, a blade-like cleaning blade constituted by a supporting member formed with a metal plate or the like containing iron as a main component and by an elastic blade formed of an urethane rubber or the like has be generally used. The cleaning blade is positioned and mounted on a cleaning container, with high accuracy, formed with a resin member of PS (polystyrene), ABS (acrylonitrile-butadiene-styrene) or the like. As a result, the cleaning blade is contacted to the electrophotographic photosensitive drum with a predetermined penetration depth and a set angle, thus removing the developer remaining on the electrophotographic photosensitive drum.

As described above, in order that the cleaning blade achieves a sufficient cleaning effect, an edge portion of the elastic blade is required to be contacted to the electrophotographic photosensitive drum with high positional accuracy. However, when a temperature is fluctuated by a change in environment or an operation of the image forming apparatus, parts for constituting the cleaning device are constituted by different materials and thermal expansion coefficient is different depending on the parts. Therefore, there arises a difference in amount of thermal expansion and contraction, so that there is a possibility of an occurrence of deformation.

In order to suppress these deformations, a thickness of the metal plate has been conventionally increased. Further, as another means for enhancing a strength of the metal plate, the metal plate has been conventionally subjected to a plurality of bending processes.

Further, according to a conventional technique, as described in Japanese Laid-Open Patent Application 2000-19930, a constitution in which a reinforcing member having the thermal expansion coefficient equivalent to that of the supporting member for the cleaning blade is provided on an opposite side to the cleaning blade via the cleaning device has been proposed. As a result, the deformation, such as curvature, of the cleaning blade caused by a difference in thermal expansion coefficient (bimetal) can be restricted and suppressed by the members (the supporting member and the reinforcing member) provided on both sides while sandwiching the cleaning device.

However, these means are disadvantageous in terms of cost, and weight reduction and downsizing of the cleaning device.

SUMMARY OF THE INVENTION

A principal object of the present invention is to provide a cleaning device which has solved the problems of the conventional technique and has improved on the conventional technique.

That is, an object of the present invention is to provide a cleaning device having realized a reduction in a fluctuation itself of a cleaning blade (elastic blade) due to a temperature change. Further to say, another object of the present invention is to provide a cleaning device capable of stably maintaining a cleaning performance while suppressing fluctuations in penetration amount and set angle of the elastic blade with respect to an image bearing member, due to the temperature change, at the minimum.

A further object of the present invention is to provide a cartridge and an image forming apparatus which include the above-improved cleaning device.

According to an aspect of the present invention, there is provided a cleaning device for removing a developer remaining on an image bearing member from the image bearing member, the cleaning device comprising:

cleaning means, including an elastic blade elastically contacted to the image bearing member and a supporting member for supporting the elastic blade, for removing the developer remaining on the image bearing member from the image bearing member;

an image bearing member bearing member including a supporting portion for rotatably supporting the image bearing member; and a removed developer accommodating container formed of a material having a thermal expansion coefficient different from that of a material for the supporting member, the removed developer accommodating container including an accommodating portion for accommodating the developer removed by the cleaning means, wherein the image bearing member bearing member is fixed to the supporting member, wherein the removed developer accommodating container is fixed to the supporting member, and wherein the image bearing member bearing member and the removed developer accommodating container are provided with a gap therebetween with respect to a longitudinal direction of the supporting member.

According to another aspect of the present invention, there is provided a cleaning device for removing a developer remaining on an image bearing member from the image bearing member, the cleaning device comprising:

cleaning means, including an elastic blade elastically contacted to the image bearing member and a supporting member for supporting the elastic blade, for removing the developer remaining on the image bearing member from the image bearing member;

an image bearing member bearing member including a supporting portion for rotatably supporting the image bearing member; and a removed developer accommodating container formed of a material having a thermal expansion coefficient different from that of a material for the supporting member, the removed developer accommodating container including an accommodating portion for accommodating the developer removed by the cleaning means, wherein the image bearing member bearing member is fixed at longitudinal ends of the supporting member, wherein the removed developer accommodating container is fixed to the image bearing member bearing member fixed at one longitudinal end of the supporting member, and wherein the image bearing member bearing member fixed at the other longitudinal end of the supporting member and the removed developer accommodating container are provided with a gap therebetween with respect to a longitudinal direction of the supporting member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
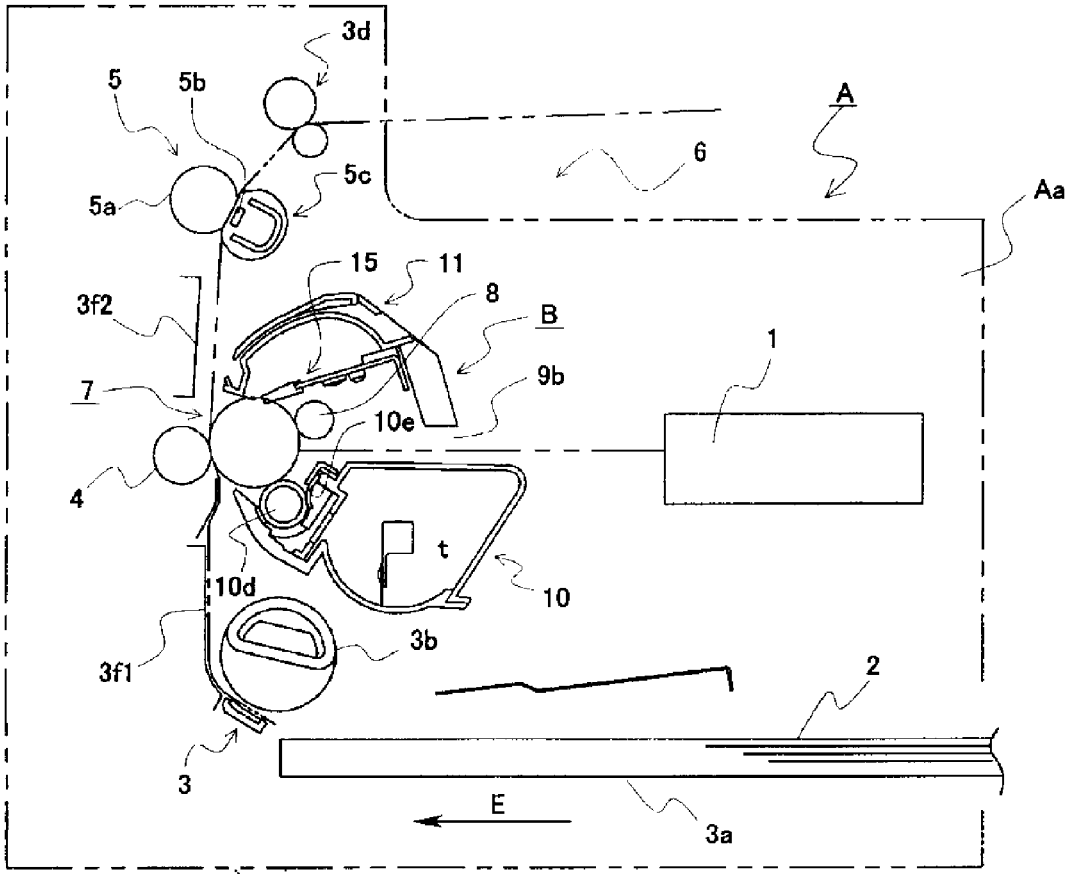
FIG. 1 is a sectional side view showing a general structure of an electrophotographic image forming apparatus according to an embodiment of the present invention.

Next, a cleaning device, a process cartridge and an electrophotographic image forming apparatus to which the process cartridge is detachably mountable according to an embodiment of the present invention will be described with reference to the drawing. Incidentally, in this embodiment, the electrophotographic image forming apparatus configured to form an image on an electrophotographic photosensitive drum using an electrophotographic image forming process and a process cartridge detachably mounted to the electrophotographic image forming apparatus are described as an example.

(General Structure of Electrophotographic Image Forming Apparatus)

First, a general structure of an electrophotographic image forming apparatus A will be described with reference to FIGS. 1 and 2.

Incidentally, FIG. 1 is a sectional side view, of the image forming apparatus, showing a state in which a process cartridge B is mounted thereto. FIG. 2 is a sectional side view of the process cartridge B.

Image formation by the electrophotographic image forming apparatus A in this embodiment will be described.

First, as illustrated in FIG. 1, a laser light image formed based on image information is irradiated from an optical system 1 onto an electrophotographic photosensitive member (image bearing member), i.e., an electrophotographic photosensitive drum (hereinafter referred to as a "photosensitive drum") 7, which is shaped in a drum-like shape having a photosensitive layer. Thus, an electrostatic latent image is formed on the photosensitive drum 7. Voltage is applied to a developing roller 10*d*, which constitutes a developing device as a developing means and which is a developer carrying member for carrying thereon a developer t, and thus the developer t is transferred onto the photosensitive drum 7 from the developing roller 10*d*. Thus, an image of the developer t is formed on the photosensitive drum 7.

A recording material 2, which is a recording medium (a recording sheet, an overhead projector (OHP) sheet, or the like), is conveyed from a cassette 3*a* by a conveying means 3*b* in a direction indicated by an arrow E in synchronization with the forming of the developer image, and is guided by a first guide plate 3*f*1 to be conveyed to an image forming portion. Then, the developer image, which is formed on the photosensitive drum 7 by the image forming portion provided as a process cartridge (hereinafter simply referred to as a "cartridge") B, is transferred onto the recording material 2 by application of a voltage to a transfer roller 4, which is a transfer means. The recording material 2 is then guided by a second guide plate 3*f*2 to be conveyed to a fixing means 5. The fixing means 5 includes a driving roller 5*a* and a fixing roller 5*c* containing a heater 5*b*. The recording material 2, which has passed through the fixing roller 5*c*, is conveyed by a discharging roller pair 3*d* and then is discharged to a discharge portion 6. Incidentally, in the electrophotographic image forming apparatus A, the recording material 2 can be manually fed via a manual feed tray (not shown) and a roller (not shown).

(Structure of Cartridge)

In this embodiment, the cartridge B includes the photosensitive drum 7 and a process means, which includes at least a cleaning device 11 as a cleaning means provided with a cleaning blade 15 for removing a developer remaining on the photosensitive drum 7 from the photosensitive drum 7.

Figure 2:
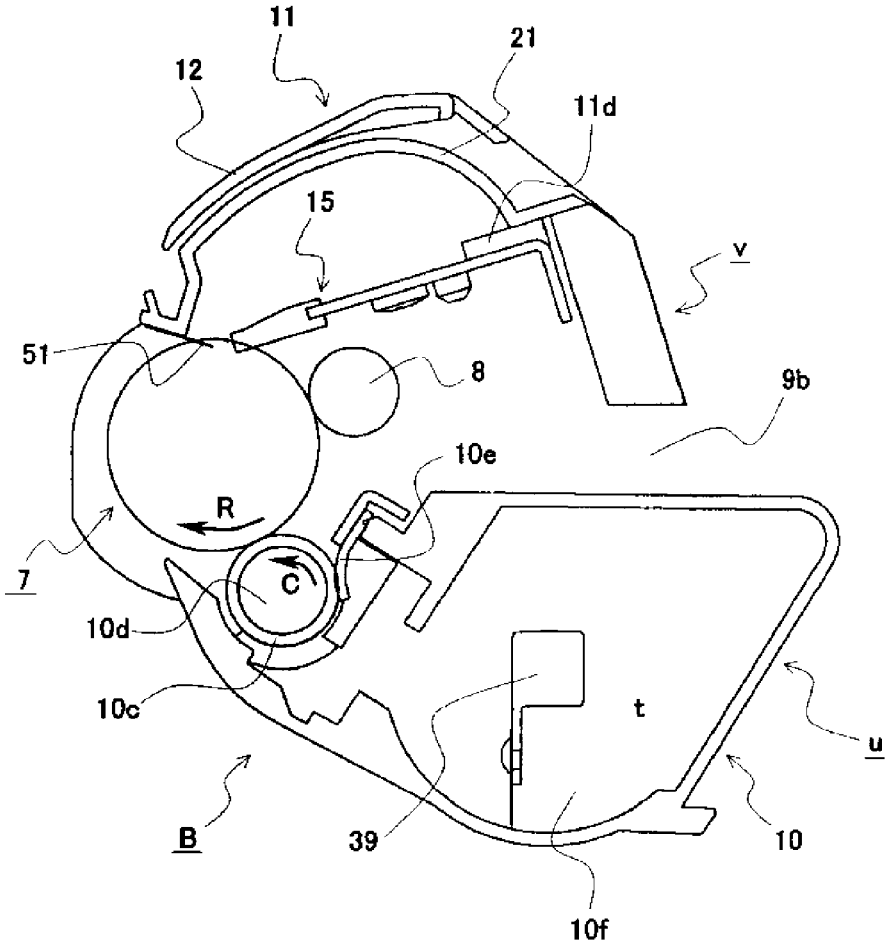
FIG. 2 is a sectional side view showing a general structure of a process cartridge according to the embodiment of the present invention.

As illustrated in FIG. 2, when the image is formed by using the cartridge B, the photosensitive drum 7 rotates in a direction indicated by an arrow R. The surface of the photosensitive drum 7 is evenly charged by a charging roller 8 as a charging means.

Then, light emitted from the optical system 1 passes through an exposure opening portion 9*b* included in the cleaning device 11 as a photosensitive member frame member, so as to expose the circumferential surface of the photosensitive drum 7. An electrostatic latent image is thus formed on the photosensitive drum 7.

A developing container 10 includes a developer regulating member (developing blade) 10*e* and the developing roller 10*d*. Further, the developing container 10 includes a developer storing portion 10*f* for storing the developer t to be supplied to the developing roller 10*d*. The developer t on the developing roller 10*d* is regulated by the developing blade 10*e*, and thus an even developer layer is formed on the developing roller 10*d*. By applying a developing bias (voltage) to the developing roller 10*d*, the developer t is transferred onto the photosensitive drum 7 depending on the formed latent image. Thus, a developer image depending on the latent image is formed on the photosensitive drum 7. The formed developer image is transferred onto the recording material 2 by applying a transfer bias (voltage) to the transfer roller 4 (FIG. 1).

As shown in FIG. 2, the developer remaining on the surface of the photosensitive drum 7 after the developer image is transferred onto the recording material 2 is removed by a cleaning blade 15 of the cleaning device 11. The removed developer is collected into a removed developer accommodating portion (e.g., container) 21. The removed developer accommodating container 21 is provided with a sheet member 51, for collecting the removed developer, at an upstream position of the photosensitive drum 7 with respect to the rotational direction R. Further, a seal member 11*d* is provided between the removed developer accommodating container 21 and the cleaning blade 15 so that the removed developer accommodated in the removed developer accommodating container 21 is not leaked.

A protective shutter 12 is attached to the cleaning device 11 for the purpose of protecting the photosensitive drum 7. The protective shutter 12 is located at a protective position (not shown) in which the photosensitive drum 7 is covered when the cartridge B is not in use. The protective shutter 12 is provided rotatable between the protective position and an exposure position in which the photosensitive drum 7 is exposed from the surface of the cartridge B when the cartridge B is in use (when the cartridge B is mounted in the image forming apparatus main assembly) as illustrated in FIG. 2.

Figure 3:
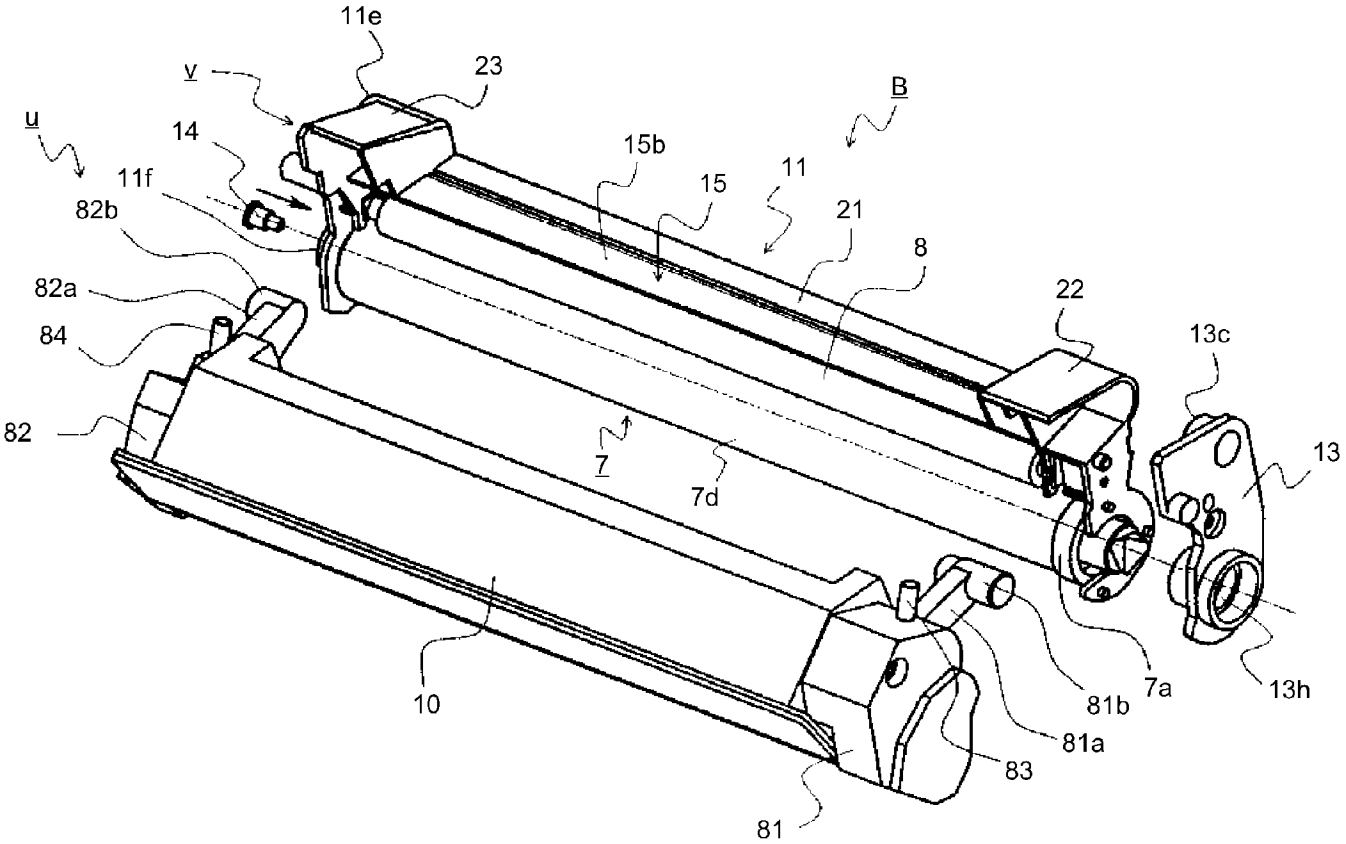
FIGS. 3 and 4 are perspective views showing a general structure of the process cartridge.

FIG. 3 is a perspective view showing a general structure of the process cartridge in this embodiment.

As illustrated in FIG. 3, the cartridge B includes a cleaning unit v as a first unit, a developing unit u as a second unit, and a drum holder 13.

The cleaning unit v includes the removed developer accommodating container 21, an electrophotographic photosensitive drum bearing member (hereinafter referred to as a "drum bearing member") (driving side) 22 and an electrophotographic photosensitive drum bearing member (hereinafter referred to as a "drum bearing member") (non-driving side) 23. The electrophotographic photosensitive drum bearing members 22 and 23 are image bearing member bearing members. Further, the cleaning unit v includes the photosensitive drum 7, the charging roller 8, and the cleaning blade 15.

The developing unit u includes a development frame member and the developing roller 10*d* (FIG. 2). The development frame member includes the developing container 10 and end portion members 81 and 82. The end portion members 81 and 82 are fixed at both ends of the developing container 10 in the longitudinal direction thereof, and the development frame member (the positioning container 10 and the end portion members 81 and 82) rotatably supports both ends of the developing roller 10*d* (FIG. 2) in the longitudinal direction. Further, the drum holder 13 is fixed to the cleaning device 11 and rotatably supports the photosensitive drum 7 and the developing unit u.

Next, a constitution for supporting the developing unit u with the cleaning unit v will be described.

As illustrated in FIG. 3, the developing unit u includes the developing container 10 and the end portion members 81 and 82. As described above, the end portion members 81 and 82 are attached to the developing container 10 in the longitudinal direction of the developing container 10, respectively. Further, the end portion members 81 and 82 include an arm portion 81*a* and an arm portion 82*a*, respectively. Here, the arm portions 81*a* and 82*a* protrude towards the cleaning unit v (in a direction crossing the longitudinal direction of the developing container 10). At front edges of the arm portions 81*a* and 82*a*, a one-end rocking (fulcrum) shaft 81*b* as a one-end portion to be supported (one-end supported portion), and another-end rocking (fulcrum) shaft 82*b* as an another-end portion to be supported are respectively provided. In this embodiment, the rocking shafts 81*b* and 82*b* are cylindrically shaped.

At the other end, the photosensitive drum 7 is rotatably supported by a drum shaft 14 as a photosensitive member supporting portion provided on the cleaning device 11.

The drum shaft 14 is press-fit in a hole (not shown) provided on a first portion to be guided (first guided portion) 11*f*. The first guided portion 11*f* is disposed at the other end of the cleaning device 11. Further, at the one end, the photosensitive drum 7 is rotatably supported by a drum supporting portion 13*h* as a second supporting portion. Here, the drum holder 13 attached to the cleaning device 11 at the one end includes the drum supporting portion 13*h*. The cleaning device 11 rotatably supports the photosensitive drum 7 via the drum holder 13 at the one end and rotatably supports the photosensitive drum 7 by the drum shaft 14 at the other end.

Further, at the other end, the cleaning device 11 has a fitting (engaging) hole 11*e* as another end supporting portion. Further, the drum holder 13 has a fitting hole 13*c* as a first supporting portion. The fulcrum shafts 81*b* and 82*b* are fitted in the fitting holes 13*c* and 11*e*, respectively. Thus, at the one end, the fitting hole 13*c* swingably supports the fulcrum shaft 81*b* (i.e., the drum holder 13 swingably supports the development frame member at the one end), and at the other end, the fitting hole 11*e* rotatably supports the fulcrum shaft 82*b*. That is, the developing unit u is rotatably (swingably) supported by the cleaning unit v.

As this time, the position of the arm portion 81*a* as a portion to be restricted (restricted portion) in the longitudinal direction is restricted between a longitudinal direction restriction portion (not shown), which is provided on the cleaning frame member 11 at the one end, and an arm abutting portion (not shown), which is a restriction portion provided on the drum holder 13. Thus, the position of the developing unit u in the longitudinal direction with respect to the cleaning unit v is restricted.

Figure 4:
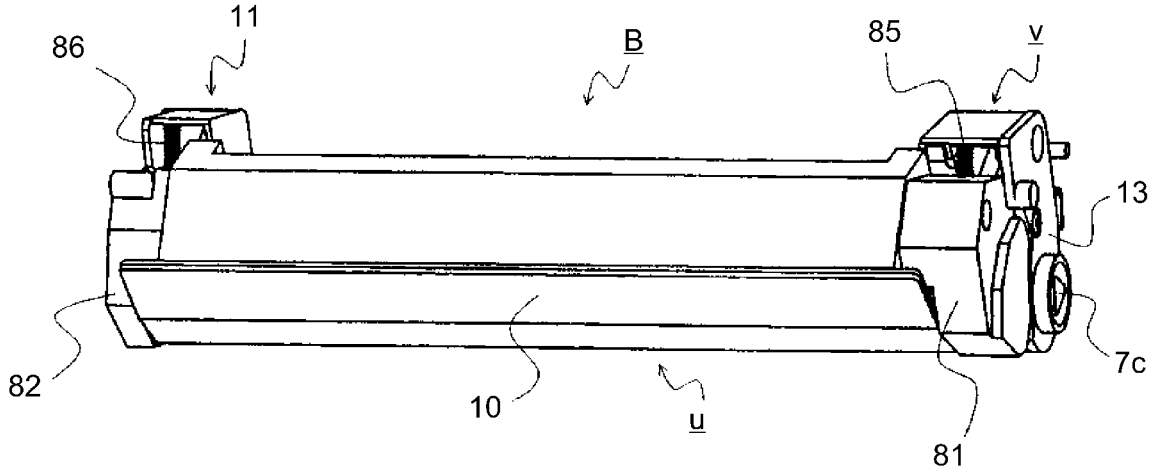

FIG. 4 is a perspective view showing a general structure of the process cartridge B in this embodiment.

As illustrated in FIG. 4, compression coil springs 85 and 86 as a biasing member are fit around spring holders 83 and 84 (FIG. 3), which are provided on the end portion members 81 and 82, respectively. The springs 85 and 86 are disposed (compressed) between each of the end portion members 81 and 82 and the cleaning device 11. Thus, the developing unit u is urged towards the photosensitive drum 7, and a ring-like gap maintaining member 10*c* (FIG. 2), which is provided on both ends of the developing roller 10*d*, contacts the photosensitive drum 7. Thus, the developing roller 10*d* and the photosensitive drum 7 oppose each other with a predetermined gap.

By employing the above-described constitution, according to this embodiment, the cleaning unit v can swingably support the developing unit u without the need to use a connection pin or the like. In addition, at the above-described other end, the drum holder 13 supports both the photosensitive drum 7 and the developing unit u (the fulcrum shaft 81*b*). Accordingly, the relative position of the photosensitive drum 7 to the developing roller 10*d*, which is supported by the developing unit u, can be accurately determined.

Furthermore, as shown in FIG. 3, to transfer (input) a driving force from an electrophotographic image forming apparatus (hereinafter referred to as an "apparatus main assembly") Aa to the photosensitive drum 7, a drum gear 7*a* is provided on the photosensitive drum 7 at the one end. In addition, to transfer the driving force from the apparatus main assembly Aa to the developing roller 10*d* (FIG. 2), a developing roller gear (not shown) is attached to the one end of the developing roller 10*d* in the longitudinal direction. In addition, an idler gear (not shown) for transferring the driving force from the developing roller gear to a conveyance gear (not shown) connected to a developer conveyance member 39 (FIG. 2) is provided at the one end. The end portion member 81 covers a gear train (not shown) including the developing roller gear, the conveyance gear, and the idler gear.

(Detail Structure of Cleaning Device)

Next, a detail structure of the cleaning device 11 will be described.

Figure 5:
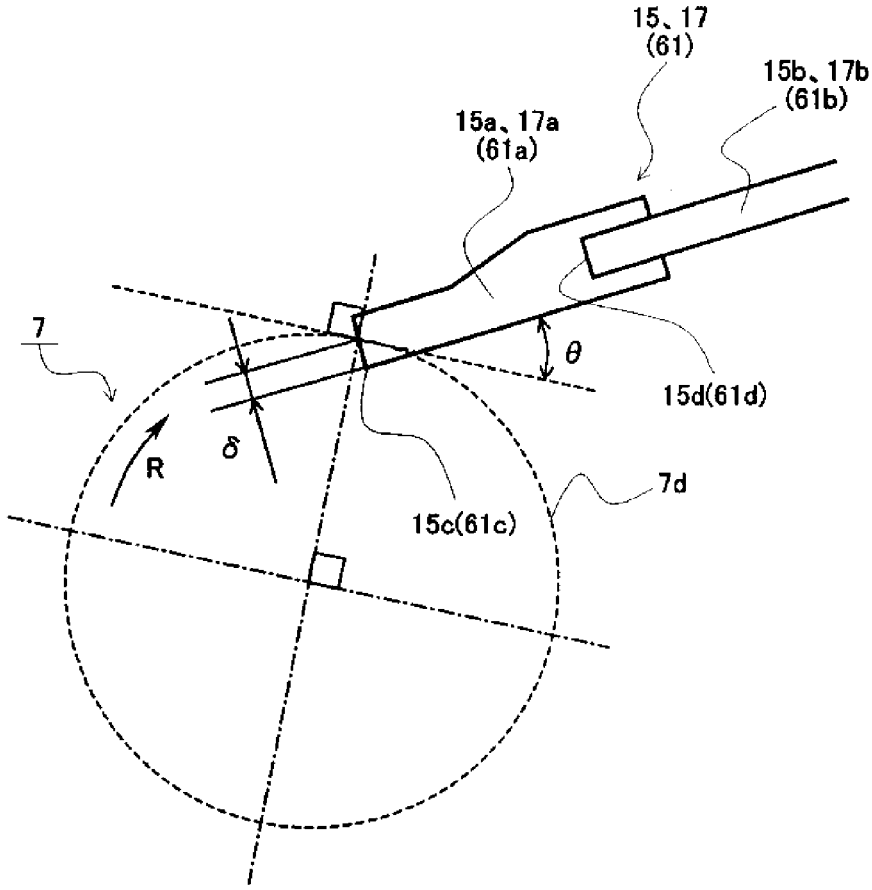
FIG. 5 is a sectional side view showing setting of a cleaning blade.

FIG. 5 is a sectional side view of the cleaning portion only which is enlarged in the sectional side view of FIG. 2 showing the general structure of the cartridge B.

First, with reference to FIG. 5, cleaning setting will be described.

The cleaning blade 15 is constituted by an elastic blade 15*a* elastically contacted to the photosensitive drum 7 and a supporting member 15*b* for supporting the elastic blade 15 in order to remove the developer remaining on the photosensitive drum 7. The elastic blade 15*a* is formed with a polyurethane rubber and is integrally held at a front end portion of the supporting member 15*b* formed with a metal plate containing metal as a main component, thus being contacted to the surface of the photosensitive drum 7 from a direction opposite from the rotational direction R (i.e., in a counter direction) with a predetermined penetration amount (depth) δ and a predetermined set angle θ.

Here, the penetration amount δ is entering length of a front end surface of the elastic blade 15*a* when the front end surface of the elastic blade 15*a* is assumed to enter the photosensitive drum 7 as it is without being deformed. Further, the set angle θ is an angle formed between an axial line of the elastic blade 15*a* and a tangent line at a point of intersection of the photosensitive drum 7 and the front end surface of the elastic blade 15*a*.

The penetration amount δ and the set angle θ which are two parameters for determining the setting of the cleaning blade 15 are required to be maintained with high precision. This is because when the penetration amount δ and the set angle θ are largely fluctuated by external factors, the removed developer passes through the elastic blade 15*a*, so that there is a possibility of an occurrence of defective cleaning by which a print image is contaminated. Further, this is also because the elastic blade 15*a* is turned up by the rotation of the photosensitive drum 7 and thus there is a possibility that the defective cleaning occurs.

The present invention will be described more specifically based on Embodiments.

Before Embodiments of the present invention is specifically described, in order to clarify a structural feature in Embodiments of the present invention, first, a cleaning device according to Comparative Embodiment will be described.

(Comparative Embodiment)

Figure 12:
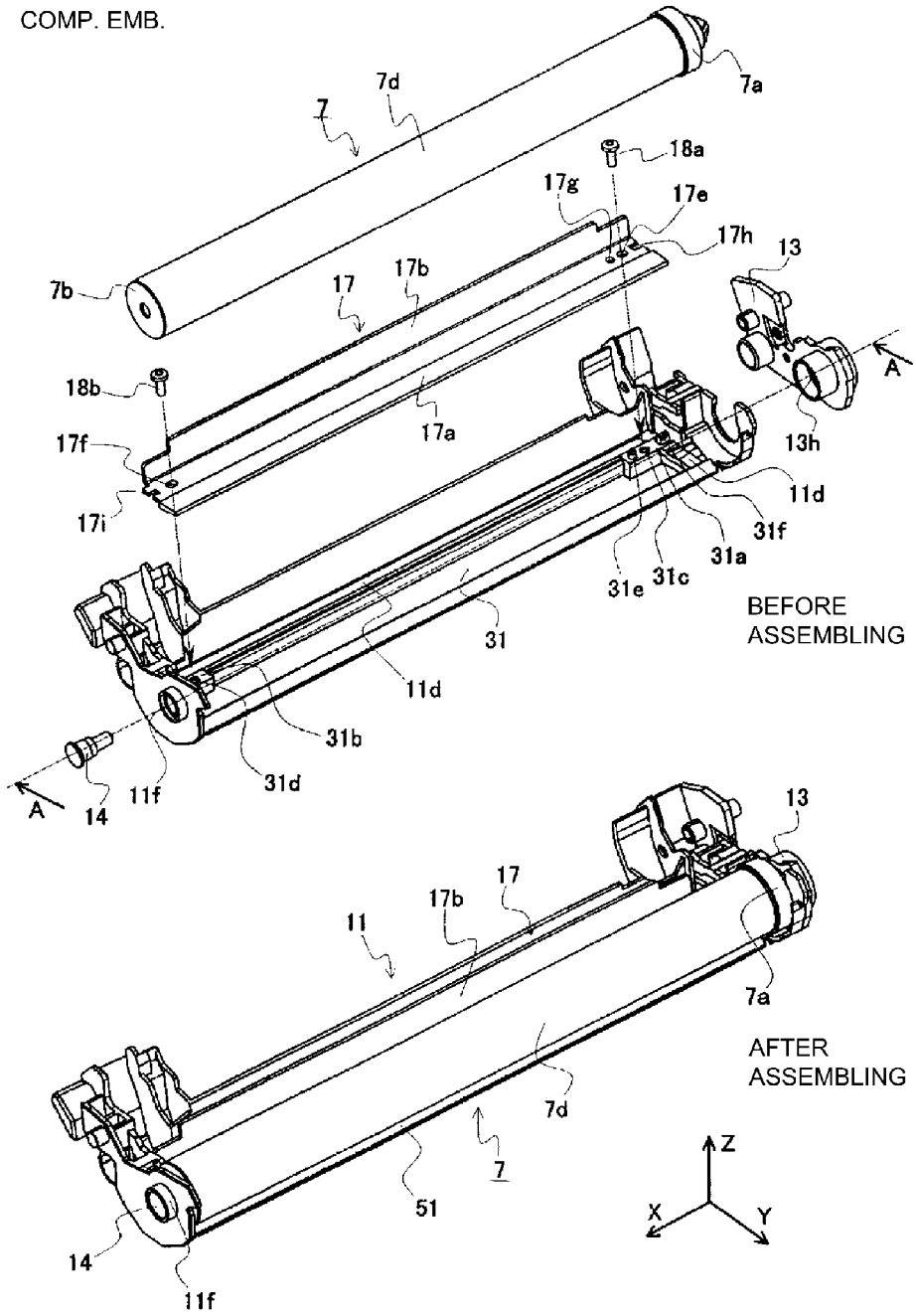
FIG. 12 includes an exploded view and an assembling view which show a general structure of a cleaning device in Comparative Embodiment.

FIG. 12 illustrates a structure of a cleaning device 11 in Comparative Embodiment. In FIG. 12, an exploded view of the cleaning device 11 before assembling is shown as an upper view, and a final view of the cleaning device 11 after the assembling is shown as a lower view.

Figure 13:
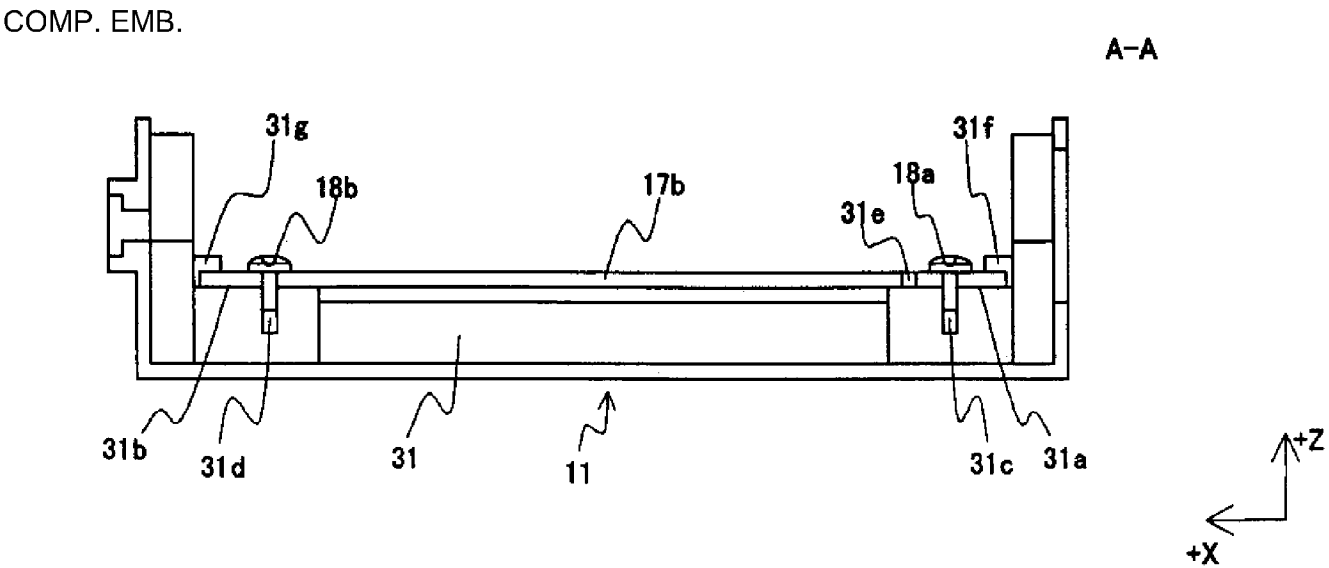
FIG. 13 is a schematic sectional view showing a structure of the cleaning device in Comparative Embodiment.

FIG. 13 is a schematic sectional front view of the cleaning device 11, after the assembling in FIG. 12, cut along a plane which passes through a center of axis of the photosensitive drum 7 and is perpendicular to the supporting member 17*b* of the cleaning blade. FIG. 13 schematically illustrates only a portion relating to the present invention.

As shown in the upper view (before the assembling), the cleaning device 11 is principally constituted by a cleaning container 31 and a cleaning blade 17 which is constituted by an elastic blade 17*a* and a supporting member 17*b*.

Here, the cleaning container 31 is provided with a seal member 11*d* so that the removed developer is leaked.

The supporting member 17*b* is screwed and fixed with tap tight screws 18*a* and 18*b* on bearing surfaces 31*a* and 31*b* located at both end portions in the longitudinal direction (longitudinal end portions) of the cleaning container 31, at one end in the longitudinal direction (longitudinal one end) and at another end in the longitudinal direction (longitudinal another end). At that time, the screws 18*a* and 18*b* are inserted into holes 17*e* and 17*f* provided in the supporting member 17*b* and then are screwed into holes 31*c* and 31*d* provided in the bearing surfaces 31*a* and 31*b*.

In FIG. 12, the position of the cleaning blade 17 in the cleaning container 31 with respect to the longitudinal direction (a direction indicated by an arrow X) is determined by engaging a positioning pin 31*e*, provided on the bearing surface 31*a*, with an elongated circular hole 17*g* provided in the supporting member 17*b*. Further, the position of the cleaning container 31 with respect to a widthwise direction (a direction indicated by an arrow Y) is determined by engaging rectangular basses 31*f* and 31*g* (FIG. 13), provided on the bearing surfaces 31*a* and 31*b*, with cuts 17*h* and 17*i* provided in the supporting member 17*b*. Further, the position of the cleaning blade 17 in the cleaning container 17 with respect to a height direction (a direction indicated by an arrow Z) is determined by the height of the bearing surfaces 31*a* and 31*b*. Thus, the cleaning blade 17 is contacted to the photosensitive drum 7 with high accuracy.

The assembling of the photosensitive drum 7, the drum shaft 14 and the drum holder 13 is similar to that in the method as described above in (Structure of cartridge) in the embodiment of the present invention. The lower view of FIG. 12 illustrates the cleaning device 11 after these parts are assembled. However, from FIG. 12, the assembling of the developing unit performed simultaneously by the assembling of the charging roller and the drum holder 13 is omitted.

In order to achieve a sufficient cleaning effect of the cleaning blade, an edge portion of the elastic blade is required to contact the electrophotographic photosensitive drum with high positional accuracy. However, when a temperature is fluctuated by a change in environment or an operation of the electrophotographic image forming apparatus, the parts constituting the cleaning device are constituted by different materials and thus are different in thermal expansion coefficient depending on the materials. For this reason, there arises a difference in thermal expansion and contraction amount, so that deformation occurs.

Particularly, the cleaning container 31 (resin) and the supporting member 17*b* (metal plate) of the cleaning blade 17 are, as shown in FIG. 12, screwed and fixed at two points which are remote from each other. For that reason, due to the difference in thermal expansion coefficient, bimetal (phenomenon) occurs, so that the cleaning blade 17 is curved or bent to cause fluctuations in penetration amount and set angle in some cases. The bimetal (phenomenon) is bending of a connecting member due to a change in temperature when members different in thermal expansion coefficient are connected with each other.

The supporting member 17*b* used in the cleaning device in Comparative Embodiment is formed with a zinc-coated steel having the thermal expansion coefficient of $1.2\times10^{-5}/°$ C., and the cleaning container 31 is formed of a PS (polystyrene) resin material having the thermal expansion coefficient of $8.7\times10^{-5}/°$ C.

(Embodiment 1)

The cleaning device 11 to which the present invention is applicable will be descried more specifically with reference to FIG. 6 and FIGS. 7 to 10.

Figure 6:
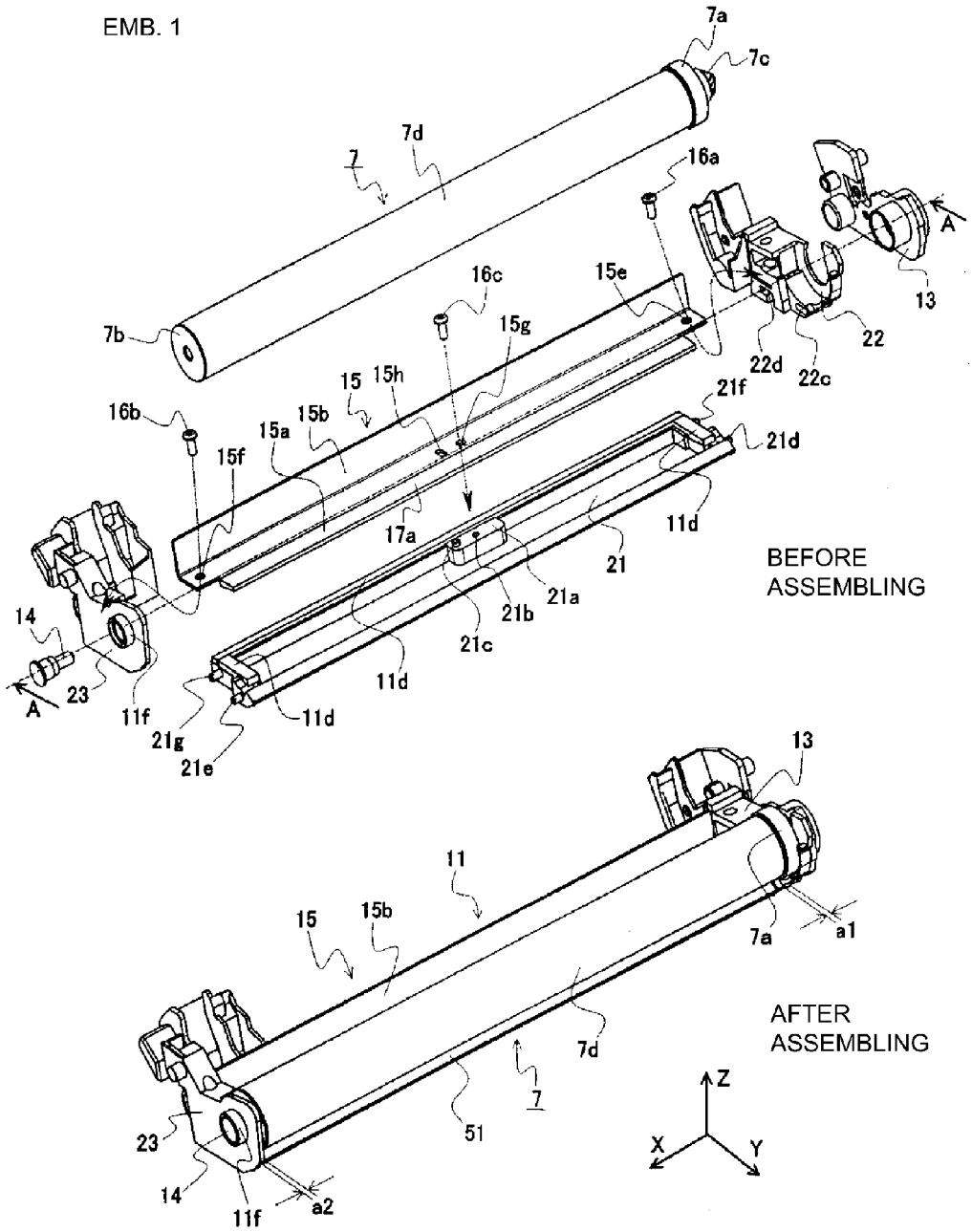
FIG. 6 includes an exploded view and an assembling view which show a general structure of a cleaning device in Embodiment 1.

FIG. 6 illustrates the cleaning device 11 to which the present invention is applicable in this embodiment, wherein an exploded view of the cleaning device 11 before assembling is shown as an upper view, and a final view of the cleaning device 11 after the assembling is shown as a lower view. However, from FIG. 6, the assembling of the developing unit performed simultaneously by the assembling of the charging roller and the drum holder 13 is omitted.

FIGS. 7 to 10 shows the structure of the cleaning device 11 to which the present invention is applicable in the order of assembling steps. In each of FIGS. 7 to 10, only the portions relating to the present invention are schematically illustrated in a left view showing a cross section taken along A-A line in FIG. 6 and in a right view showing a cross section taken along B-B line in the A-A cross section.

As shown in the upper view (before the assembling) of FIG. 6, the cleaning device 11 includes the cleaning blade 15 principally constituted by the elastic blade 15*a* and the supporting member 15*b*. Further, the cleaning device 11 is constituted by including the drum bearing members 22 and 23 to be attached to both end portions in the longitudinal direction (longitudinal end portions) of the supporting member 15*b* and including the removed developer accommodating container 21 which is an accommodating portion for accommodating the removed developer. Here, the removed developer accommodating container 21 is provided with the seal member 11*d* (which is shown in FIG. 6 but is not shown in FIGS. 7 to 10) so that the removed developer is not leaked.

Further, the photosensitive drum 7 includes the drum-like photosensitive layer 7*d* into which the developer 7*a* and a drum flange 7*b* are press-fitted and fixed at both end opening portions of the photosensitive drum 7. The drum gear 7*a* includes a drive transmitting portion (coupling) 7*c* to which the driving force is inputted from a main assembly drive input portion (not shown). Hereinafter, one end at which the drive transmitting portion 7*c* is provided is referred to as a driving side, and the other end is referred to as a non-driving side. In accordance with this, the drum bearing member 22 is a drum bearing member (driving side), and the drum bearing member 23 is a drum bearing member (non-driving side).

With reference to FIGS. 7 to 10, the structure of the cleaning device 11 to which the present invention is applicable will be described in the order of assembling.

Figure 7:
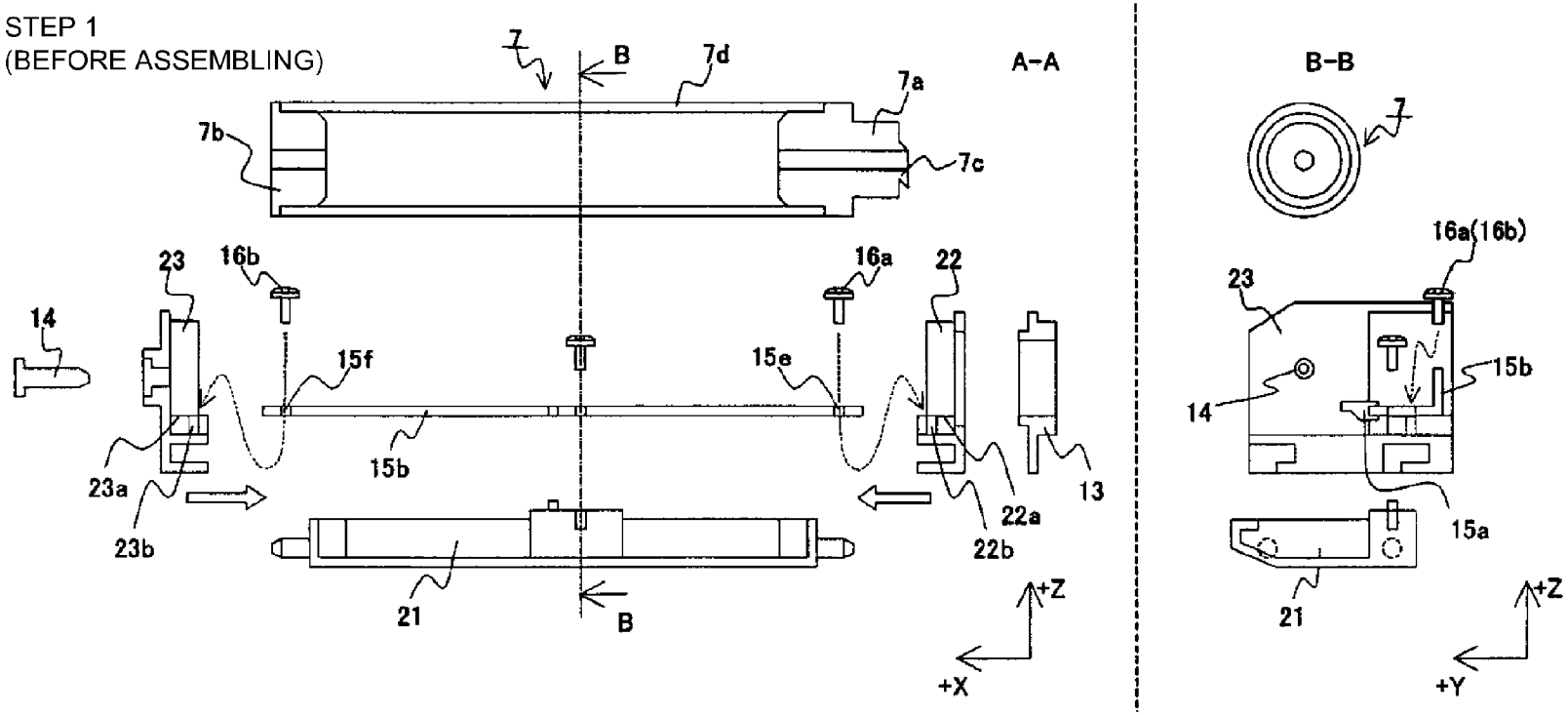
FIGS. 7 to 10 are schematic sectional views showing a procedure of assembling of the cleaning device in Embodiment 1.

In step 1 (FIG. 7), on the driving side at the one end in the longitudinal direction of the supporting member 15*b* and on the non-driving side at the other end in the longitudinal direction of the supporting member 15*b*, the drum bearing member (driving side) 22 and the drum bearing member (non-driving side) 3 are fixed to the supporting member 15*b*. FIG. 7 corresponds to the exploded view of the cleaning device 11 before the assembling shown in the upper view of FIG. 6.

As an example of a fixing method, the bearing surfaces 22*a* and 23*a* of the respective drum bearing members are aligned with the supporting member 15*b* and then are screwed and fixed with the tap tight screws 16*a* and 16*b*. The screws 16*a* and 16*b* are inserted into holes 15*e* and 15*f* provided in the supporting member 15*b* and then are screwed into the holes 22*b* and 23*b* provided in the bearing surfaces 22*a* and 23*a*. Here, a head shape of the screws 16*a* and 16*b* is not particularly limited.

At that time, a positioning method of each of the drum bearing members 22 and 23 relative to the supporting member 15*b* in each of the directions (indicated by the arrows X, Y and Z) is the same as that performed with respect to the cleaning blade 17 in the cleaning container 31 in Comparative Embodiment described above.

The position of each of the drum bearing members 22 and 23 to the supporting member 15*b* with respect to the longitudinal direction (the arrow X direction) is determined by engaging a positioning pin (not shown), which is an engaging portion provided on each of the bearing surfaces 22*a* and 23*a*, with an elongated circular hole which is a portion to be engaged provided in the supporting member 15*b*. Further, the position of each of the drum bearing members 22 and 23 to the supporting member 15*b* with respect to the widthwise direction (the arrow Y direction) is determined by engaging a rectangular boss (not shown), which the engaging portion provided on each of the bearing surfaces 22*a* and 23*a*, with a cut (not shown) which is the portion to be engaged provided in the supporting member 15*b*. Further, the position of each of the drum bearing members 22 and 23 to the supporting member with respect to the height direction (the arrow Z direction) is determined by the height of each of the bearing surfaces 22*a* and 23*a*. Thus, the cleaning blade 15 is contacted to the photosensitive drum 7 with high accuracy.

As another method, the positioning of each of the drum bearing members 22 and 23 with respect to a planar direction (the arrow XY direction) of the supporting member 15*b* may also be performed by effecting alignment of mutual parts with unshown positioning jigs and then may be fixed with screws. As a result, there is no need to ensure a space in a positioning shape, so that it is possible to downsize the parts.

Further, an adhesive may also be used without using fastening parts such as screws. As a result, it is possible to eliminate the fastening parts to realize a reduction in the number of parts. Next, in Step s (FIG. 8), the removed developer accommodating container 21 is assembled to the supporting member 15*b*.

The position of the removed developer accommodating container 21 to the supporting member 15*b* with respect to the longitudinal direction (the arrow X direction) is determined by engaging a positioning pin (engaging portion) 21*c*, provided on the bearing surface 21*a*, with an elongated circular hole (portion to be engaged) provided in the supporting member 15*b*.

Here, the cleaning device 11 includes positioning pins (engaging portion) 21*d* and 21*e* at end portions of the removed developer accommodating container 21 and corresponding positioning guides (portion to be engaged) 22*c* and 23*c* provided on the drum bearing members 22 and 23. This is because positioning stability at the end portions of the removed developer accommodating container 21 is improved.

The positioning guides (portions to be engaged) 22*c* and 23*c* have abutment surfaces against which the positioning pins (engaging portions) 21*d* and 21*e* are to be abutted with respect to the widthwise and height directions (the arrow YZ directions) of the supporting member 15*b*. By the abutment of the positioning pins (engaging portions) 21*d* and 21*e* against the abutment surfaces, the removed developer accommodating container 21 is positioned to the drum bearing members 22 and 23 with respect to the widthwise and height directions (the arrow YZ directions) of the supporting member 15*b*. Further, in order to further improve the positioning stability at the end portions of the removed developer accommodating container 21, the following constitution is employed. That is, in this embodiment, separately from the combination for the above-described positioning, positioning pins (engaging portion) 21*f* and 21*g* are provided at the end portions of the removed developer accommodating container 21 and corresponding positioning guides (portions to be engaged) 22*d* and 23*d* are provided on the drum bearing members 22 and 23. The positioning guides 22*d* and 23*d* have abutment surfaces against which the positioning pins 21*f* and 21*g* are to be abutted with respect to the height directions (the arrow Z direction) of the supporting member 15*b*. By the abutment of the positioning pins 21*f* and 21*g* against the abutment surfaces, the removed developer accommodating container 21 is positioned to the drum bearing members 22 and 23 with respect to the widthwise and height directions (the arrow Z direction) of the supporting member 15*b*. By the above constitution, it is possible to suppress positional deviation due to warpage, bending or the like of the removed developer accommodating container 21.

Figure 8:
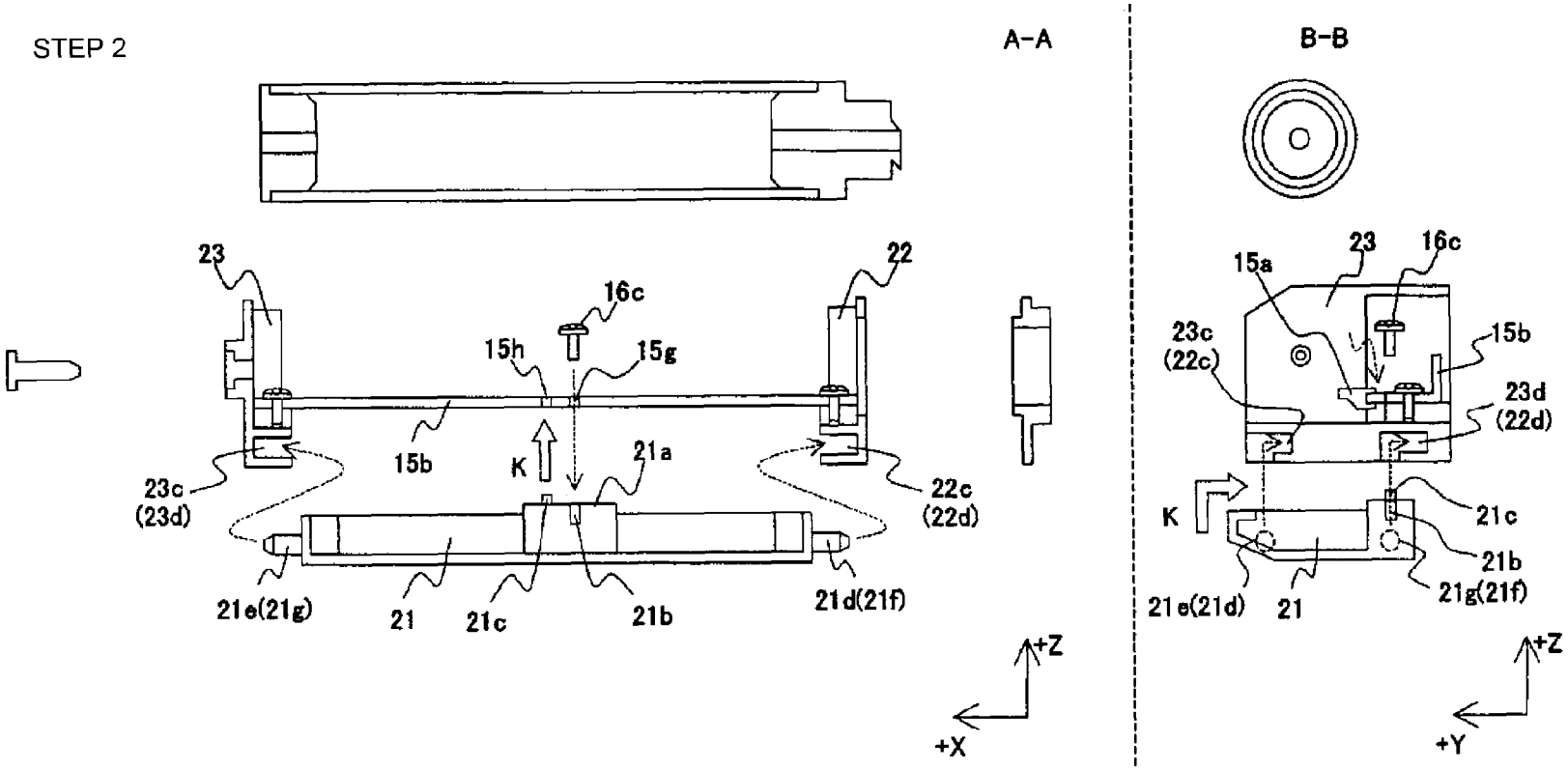

Since the above constitution is employed, as indicated by an arrow K shown in the B-B cross section of FIG. 8 (Step 2), the removed developer accommodating container 21 is slid and assembled to the supporting member 15*b*.

After the above-described assembling and positioning are completed, the bearing surface 21*a* of the removed developer accommodating container 21 is, at a longitudinal central portion of the supporting member 15*b*, screwed and fixed with a tap tight screw 16*c*. At that time, the screw 16*c* is inserted into a hole 15*g* provided in the supporting member 15*b* and then is screwed into a hole 21*b* provided in the bearing surface 21*a*. Also in this case, a head shape of the screw 16*c* is not particularly limited.

By the above constitution, the removed developer accommodating container 21 can be assembled to the cleaning blade 15 or the photosensitive drum 7 with high accuracy.

Figure 9:
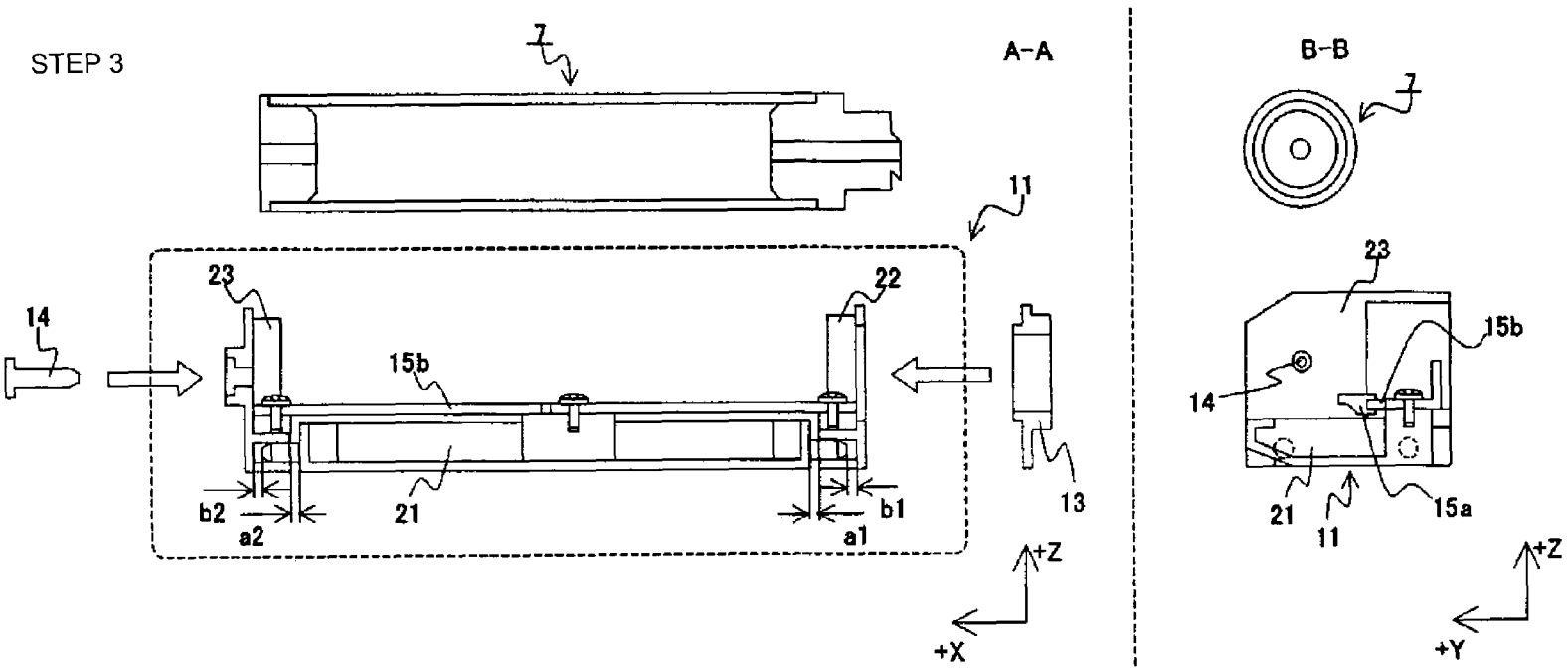

The cleaning device 11 enclosed by a broken-line portion shown in FIG. 9 (Step 3) has a constitution which best reflects the feature of the present invention.

The cleaning device 11 assembled via Steps 1 and 2 includes, as shown in FIG. 9 (Step 3), the drum bearing member (driving side) 22, the drum bearing member (non-driving side) 23 and gaps a1, a2, b1 and b2 created between the parts of the removed developer accommodating container 21. As a result, mutual parts are movable with respect to the longitudinal direction (the arrow X direction) of the supporting member 15*b*. Thus, the creation of the gaps a1, a2, b1 and b2 is the most characteristic feature of the present invention.

By the above constitution, in the cleaning device 11 constituted by the members different in thermal expansion coefficient, even when the change in temperature due to the change in environment occurs and the thermal expansion and contraction amounts of the parts are different from each other, it is possible to absorb the difference in thermal expansion and contraction amount by the gaps a1, a2, b1 and b2. As a result, stretching stress is not generated between a plurality of parts and therefore it is possible to minimize the fluctuations in penetration amount δ and set angle θ of the cleaning blade 15, due to the bimetal, which have occurred in the conventional constitution.

The supporting member 15*b* to which the present invention is applicable is the zinc-coated steel plate containing iron as the main component and has the thermal expansion coefficient of $1.2\times10^{-5}/°$ C. Further, the removed developer accommodating container 21, the drum bearing member (driving side) 22, the drum bearing member (non-driving side) 23 and the drum holder 13 which are used in this embodiment to which the present invention is applicable are formed with the PS (polystyrene) resin material having the thermal expansion coefficient of $8.7\times10^{-5}/°$ C.

Here, the gaps a1, a2, b1 and b2 are, in view of an estimated temperature change in an operational environment, required so that they can sufficiently absorb the differences in contraction amount and expansion amount of the mutual parts.

Figure 11:
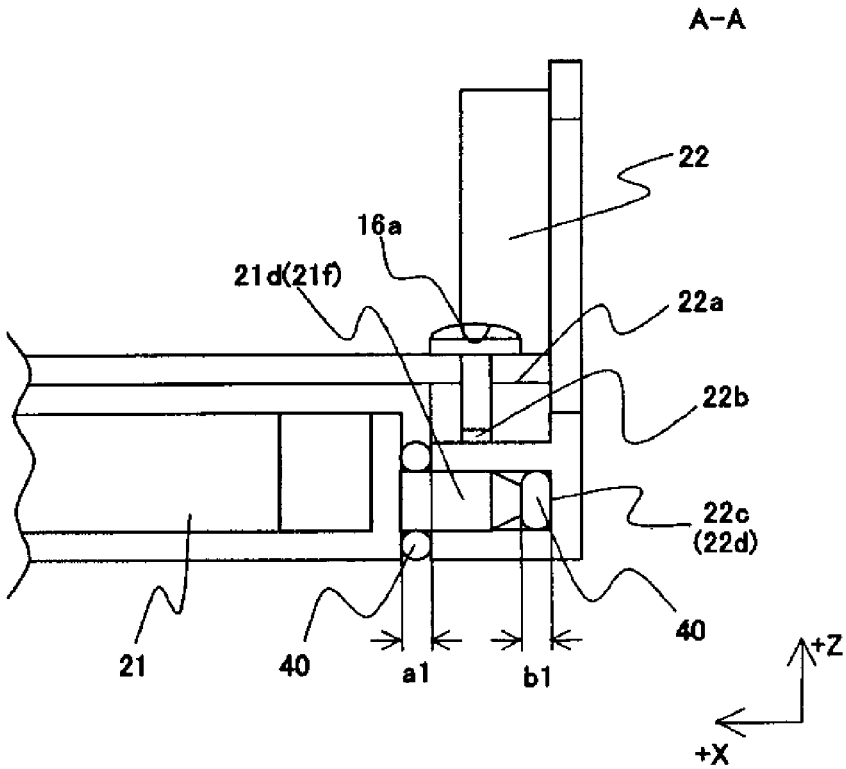
FIG. 11 is a schematic sectional view showing an end portion structure of a removed developer accommodating container in Embodiment 1.

Further, FIG. 11 shows the driving side of the cleaning device 11 shown in FIG. 9 (Step 3). As shown in FIG. 11, an elastic member can be interposed in each of the gaps a1 and b1 (a2 and b2), so that a shock-absorbing effect with respect to the longitudinal direction of the removed developer accommodating container 21 is improved. However, the elastic member 40 is required to have followability such that the elastic member 40 can quickly absorb the difference in thermal expansion and contraction amount generated by the change in environment. For example, it can be considered that rubber is used as the material for the elastic member 40. The elastic member 40 may preferably be softer than the removed developer accommodating container 21, the drum bearing member (driving side) 22 and the drum bearing member (non-driving side) 23.

Continuously, in Step 3 (FIG. 9), the assembling of the photosensitive drum 7 is performed. The photosensitive drum 7 is moved downward into the cleaning device 11 and then the drum shaft 14 and the drum holder 13 are engaged with the photosensitive drum 7 and the cleaning device 11 on the driving side and the non-driving side, respectively.

Figure 10:
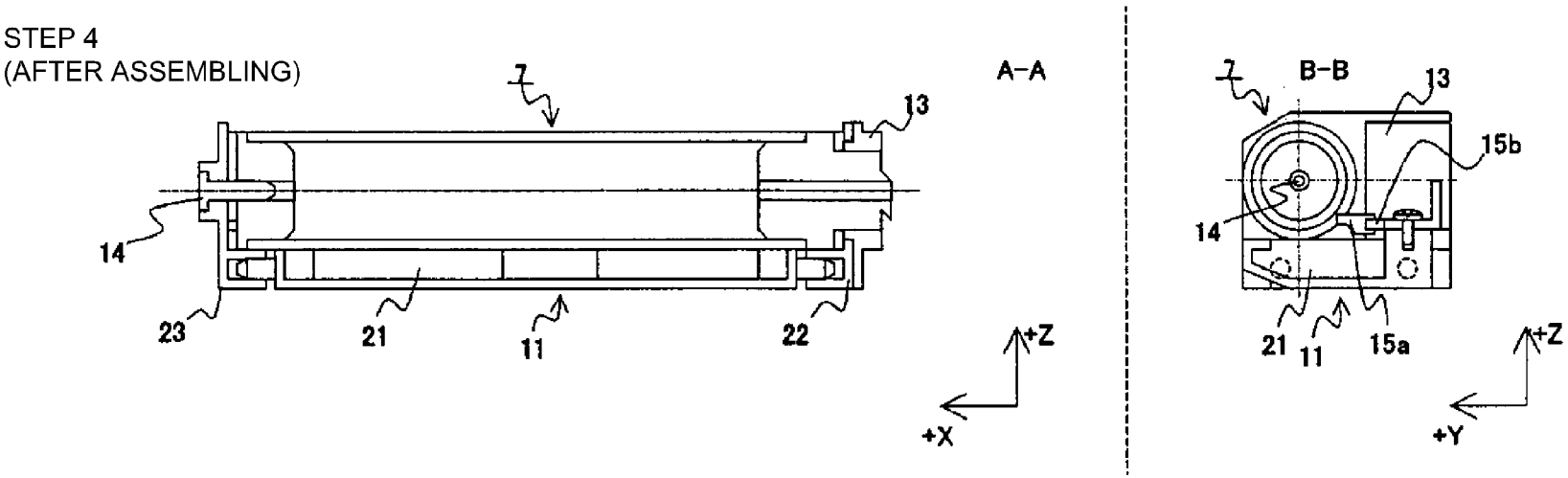

FIG. 10 (Step 4) shows a state in which the photosensitive drum 7 is assembled to the cleaning device 11 and corresponds to the lower view of FIG. 6 showing the cleaning device 11 after the assembling.

Through the above-described steps, the cleaning blade 15 is accurately contacted to the photosensitive drum 7 with a predetermined penetration amount δ and a set angle θ. Further, as described in Step 3, the fluctuation in penetration amount due to the bimetal can be minimized. Incidentally, the assembling of the developing unit u is also performed simultaneously with the assembling of the drum holder 13 but is omitted from the description in this embodiment for simplification.

Further, the order of Steps 2 and 3 can also be changed (reversed).

Further, by forming the removed developer accommodating container 21 and the drum bearing members 22 and 23 of the same material, the expansion and contraction amounts of these parts depending on the temperature change are equal to each other with respect to a widthwise cross-sectional direction (arrow YZ direction) of the supporting member 15*b* of the cleaning blade 15. As a result, even when the ambient temperature is changed, a positional relationship between the positioning pins (engaging portion) 21*d* and 21*e* (21*f* and 21*g*) and the corresponding positioning guides (portion to be engaged) 22*c* and 23*c* (22*d* and 23*d*) is maintained in an initially assembled state. For that reason, the bending does not occur, so that it is possible to realize that the positions of the supporting member 15*b* and an elastic blade edge 15*c* (FIG. 5) are not fluctuated and influenced.

As described above, according to this embodiment, with respect to the widthwise cross-sectional direction of the supporting member of the cleaning blade, the removed developer accommodating container is provided with the engaging portions and the drum bearing members are provided with the portions to be engaged in order to position the end portions of the removed developer accommodating container to the drum bearing members. As a result, positional stability at the end portions of the removed developer accommodating container in the cleaning device is improved. Further, a degree of the bending occurring when a load or the like is externally exerted on the removed developer accommodating container can be reduced. As described above, the removed developer accommodating container includes the seal member and the sheet member which are configured to collect the removed developer and thus the removed developer accommodating container is stably positioned and supported in the cleaning device to reduce the influence of the bending, so that the leakage of the developer can be prevented.

Further, as described above, the drum bearing members are not fixed completely among the mutual parts, so that the mutual parts can move in the longitudinal direction of the supporting member. As a result, even when the cleaning device is constituted by the plurality of parts different in thermal expansion coefficient, the expansion and contraction difference with respect to the longitudinal direction of the supporting member due to the temperature change of the respective parts is absorbed and thus deformation such as warpage of the cleaning blade caused by the bimetal can be minimized. That is, the fluctuations in penetration amount and set angle of the cleaning blade with respect to the photosensitive drum due to the bimetal can be minimized, thus leading to stabilization of a cleaning performance.

Further, according to this embodiment, the drum bearing members are separately fixed, as separate members, to the longitudinal end portions of the supporting member of the cleaning blade, so that there is no need to dispose a part of the drum bearing members at a central portion of the supporting member, thus leading to the reduction in use amount of the material to realize cost reduction.

Further, when the drum bearing members at the both ends of the supporting member are integrally connected with the supporting member, different from the bimetal between the supporting member and the removed developer accommodating container, new bimetal occurs between the supporting member and the drum bearing members, so that the new bimetal can constitute a fluctuation factor of the cleaning blade. Therefore, the drum bearing members can realize a smaller degree of the fluctuation when they are separately fixed, as separate members, at the both ends of the supporting member, thus leading to the stabilization of the cleaning performance.

Further, also with respect to the temperature change in the electrophotographic image forming apparatus, a similar effect can be obtained when the constitution of the present invention is employed.

(Embodiment 2)

Figure 14:
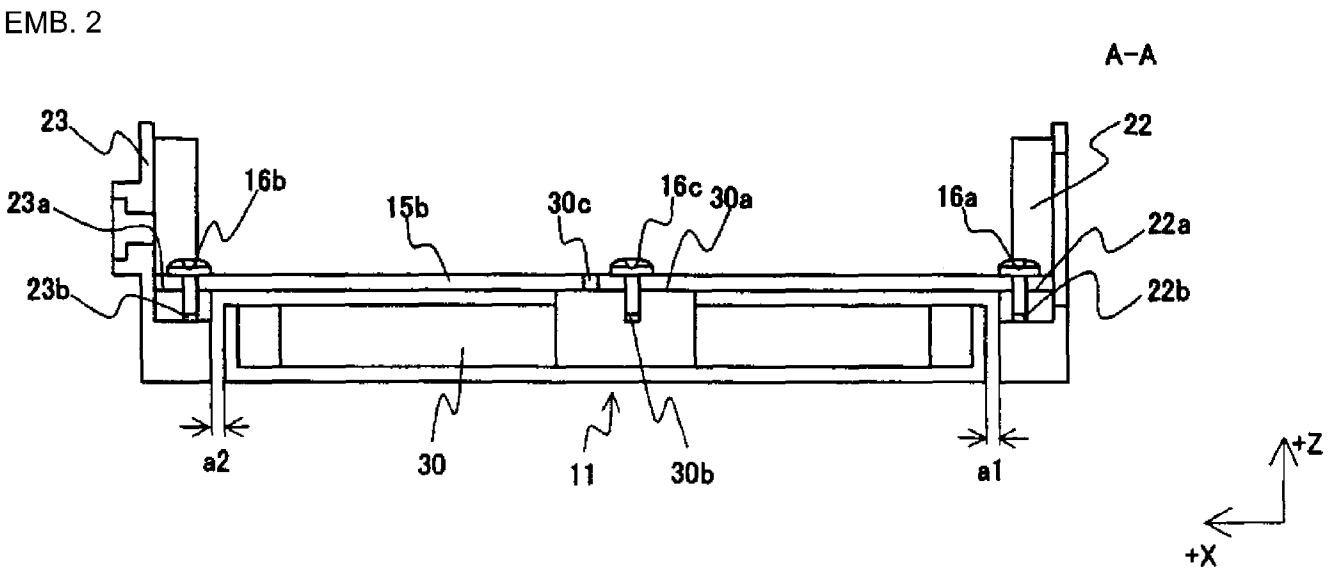
FIGS. 14 to 21 are schematic sectional views showing structures of cleaning devices in Embodiments 2 to 9, respectively.

FIG. 14 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to the supporting member 15*b* of the cleaning blade 15 is illustrated. Only a portion different from Embodiment 1 will be described and a portion which is not particularly described is identical to the corresponding portion in Embodiment 1.

As shown in FIG. 14, even in a constitution in which the positioning pins and the positioning guides are eliminated, it is possible to assemble a removed developer accommodating container 30 to the supporting member 15*b* with sufficient supporting strength and the gaps a1 and a2 are provided. For that reason, the principal object of the present invention such that the fluctuation of the cleaning blade 15 due to the bimetal is minimized can be accomplished.

In Embodiment 1, the principal object of the present invention such that the fluctuation in penetration amount due to the bimetal was minimized was accomplished and in addition, the constitution for further improving the positioning stability at the end portions of the removed developer accommodating container 21 was employed. That is, in Embodiment 1, the constitution in which the removed developer accommodating container 21 was provided with the positioning pins at its end portions and the drum bearing members 22 and 23 were provided with the corresponding positioning guides was proposed.

Also in this embodiment, the drum bearing members are fixed at the longitudinal ends of the cleaning blade supporting member and the removed developer accommodating container is fixed at the longitudinal central portion of the cleaning blade supporting member. By fixing the removed developer accommodating container to the supporting member at the longitudinal central portion of the supporting member, supporting stability of the removed developer accommodating container in the cleaning device is improved. The removed developer accommodating container includes the seal member and the sheet member which are configured to collect the removed developer, so that the leakage of the developer can be prevented by the improvement of the supporting stability of the removed developer accommodating container in the cleaning device.

(Embodiment 3)

Figure 15:
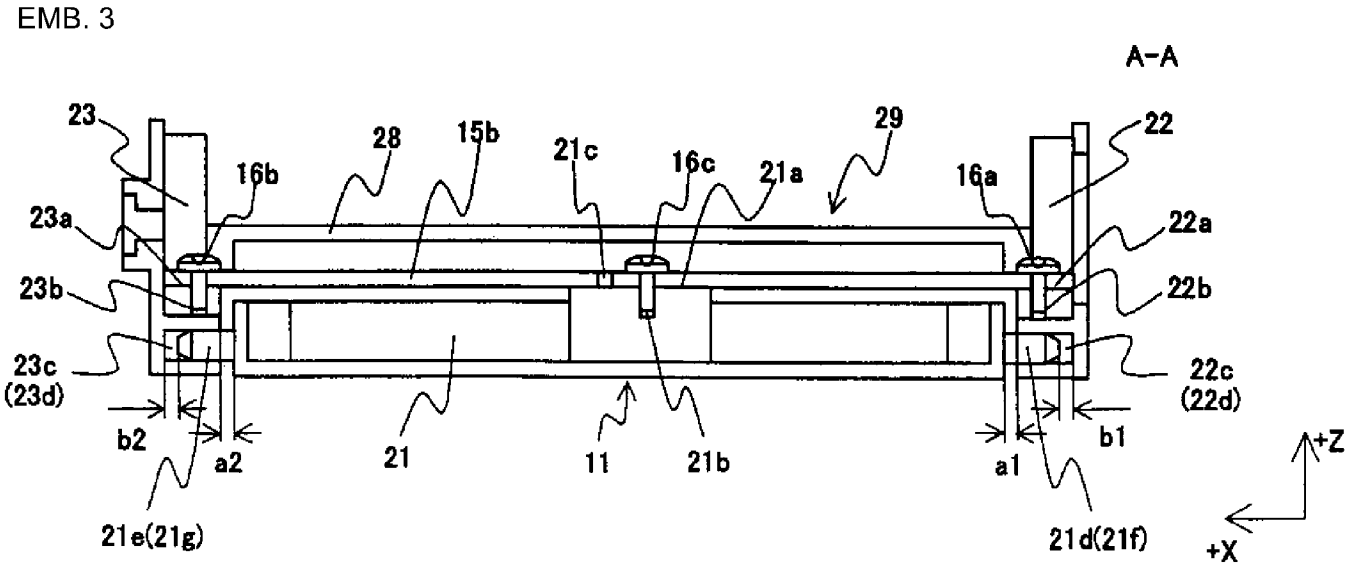

FIG. 15 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to the supporting member 15*b* of the cleaning blade 15 is illustrated. Only a portion different from Embodiment 1 will be described and a portion which is not particularly described is identical to the corresponding portion in Embodiment 1.

In the cleaning device 11 in Embodiment 1 (FIG. 9), the drum bearing member (driving side) 22 and the drum bearing member (non-driving side) 23 are separately constituted. However, as shown in FIG. 15, the drum bearing member (driving side) 22 and the drum bearing member (non-driving side) 23 are connected by a connecting portion 28 which is liable to be sufficiently bent and which has low rigidity, and these members 22, 23 and 28 may be integrally constituted as a drum bearing member 29. That is, even when the temperature change occurs in the supporting member 15*b* and the drum bearing member 29 which are members different in thermal expansion coefficient and the mutual parts have different thermal expansion and contract amounts, the connecting portion 28 may only be required to have the low rigidity such that the connecting portion 28 can be bent by absorbing the difference in thermal expansion and contraction amount.

Further, also in such a constitution, the gaps a1, a2, b1 and b2 are provided, so that the fluctuations in penetration amount δ and set angle θ due to the bimetal which have been generated in the conventional constitution can be minimized.

(Embodiment 4)

Figure 16:
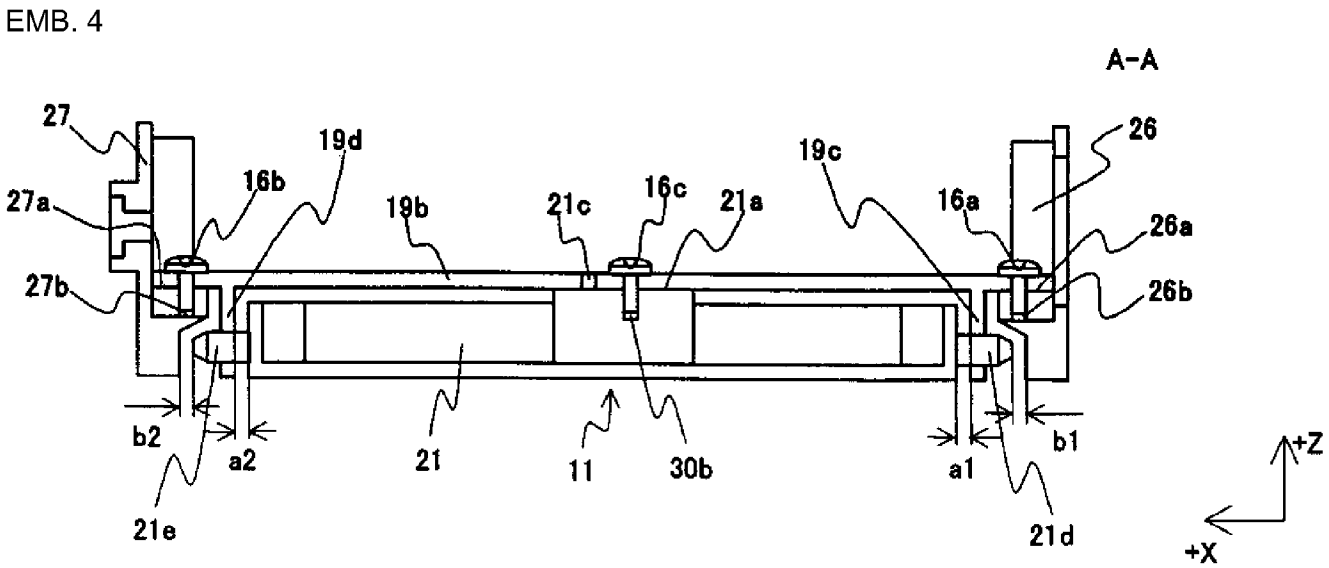

FIG. 16 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to a supporting member 19*b* of the cleaning blade is illustrated. Only a portion different from Embodiment 1 will be described and a portion which is not particularly described is identical to the corresponding portion in Embodiment 1.

In Embodiment 1 (FIG. 9), in order to improve the positioning stability at the end portions of the removed developer accommodating container 21, the removed developer accommodating container 21 is provided with the positioning pins at its end portions and the drum bearing members 22 and 23 are provided with the corresponding positioning guides. As another constitution for achieving the same effect as that of this constitution, as shown in FIG. 16, the supporting member 19*b* is partly bent at its longitudinal end portions to form a bent portion (driving side) 19*c* and a bent portion (non-driving side) 19*d* and then the positioning guides may be provided at the bent portions 19*c* and 19*d*.

Further, when the constitution in this embodiment is employed, the gaps a1, a2, b1 and b2 are provided and therefore it is possible to accomplish the principal object of the present invention such that the fluctuation in penetration amount of the cleaning blade due to the bimetal is minimized.

(Embodiment 5)

Figure 17:
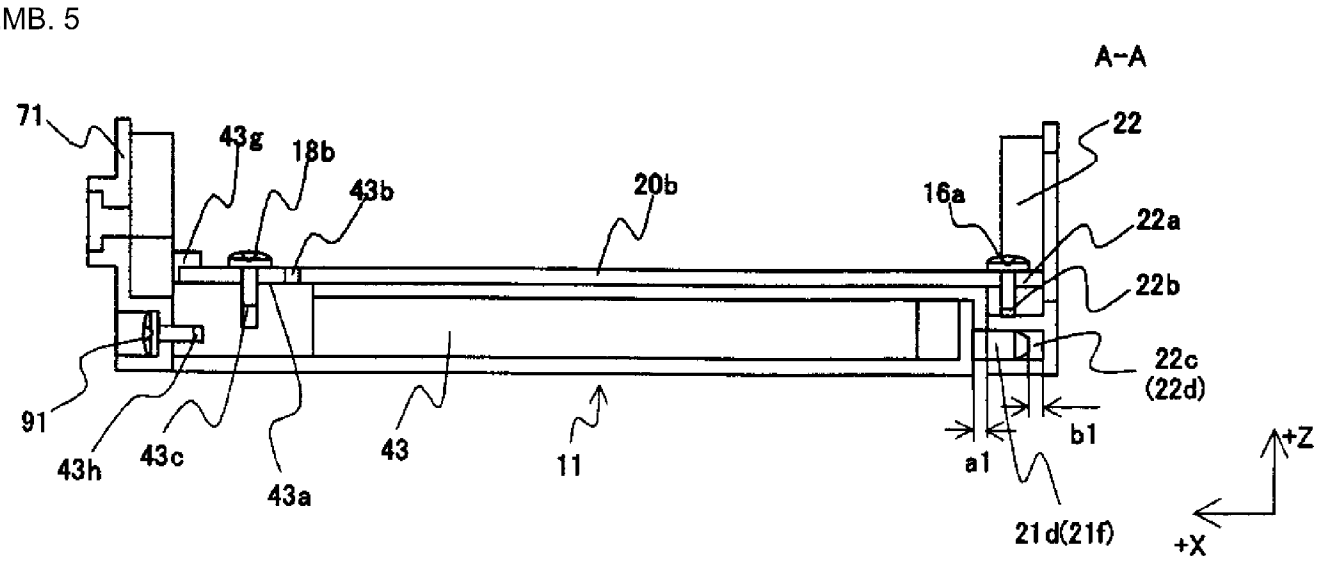

FIG. 17 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to a supporting member 20*b* of the cleaning blade is illustrated. Only a portion different from Embodiment 1 will be described and a portion which is not particularly described is identical to the corresponding portion in Embodiment 1.

FIG. 17 shows a constitution which is a combination of the constitution in Comparative Embodiment (FIG. 13) and the constitution in Embodiment 1 (FIG. 9). The cleaning blade supporting member 20*b*, a removed developer accommodating container 43 and the drum bearing member (driving side) 22 which is used in Embodiment 1 are shown.

The fixation between the supporting member 20*b* and the removed developer accommodating container 43 is effected at another end (non-driving side) of the supporting member 20*b* by using the screw 18*b* similarly as in the constitution in Comparative Embodiment. A positioning method of the removed developer accommodating container 43 to the supporting member 20*b* is similar to that in the constitution in Comparative Embodiment.

The fixation between the supporting member 20*b* and the drum bearing member (driving side) 22 is effected at one end (driving side) of the supporting member 20*b* by using the screw 16*a* similarly as in Embodiment 1 (FIG. 9). The positioning method of the drum bearing member (driving side) 22 to the supporting member 20*b* is also similar to that in Embodiment 1 (FIG. 9).

Further, similarly as in Embodiment 1 (FIG. 9), the removed developer accommodating container 43 is provided with the positioning pin 21*d* (21*f*) at its end portion and the drum bearing member (driving side) 22 is provided with the corresponding positioning guide 22*c* (22*d*). This is because the positioning stability at the end portions of the removed developer accommodating container 43 in the cleaning device 11 is improved.

Further, at the other end (non-driving side), a drum bearing member (non-driving side) 71 is fastened to a side surface of the removed developer accommodating container 43 by using a screw 91.

By the above constitution, in the cleaning device 11 constituted by the members different in thermal expansion coefficient, even when the temperature change occurs due to the change in environment and the mutual parts have different expansion and contraction amounts, the difference in expansion and contraction amount can be absorbed by the gaps a1 and b1. As a result, the fluctuation of the cleaning blade due to the bimetal which has occurred in the conventional constitution can be minimized. Further, at least one of the drum bearing members is fixed at one longitudinal end of the cleaning blade supporting member, and the removed developer accommodating container is fixed at the other longitudinal end of the cleaning blade supporting member. As a result, the fixing portion which was provided at the longitudinal central portion of the supporting member in order to fix the removed developer accommodating container in Embodiment 1 is eliminated, so that the constitution can be simplified.

(Embodiment 6)

Figure 18:
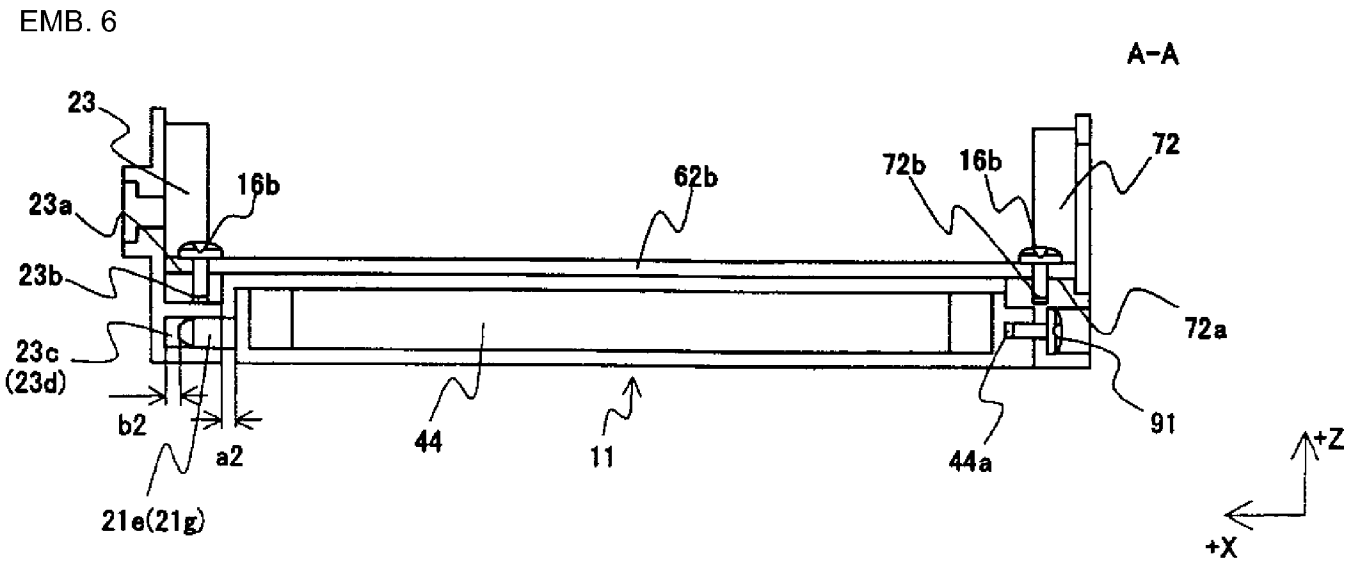

FIG. 18 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to a supporting member 62*b* of the cleaning blade is illustrated. Only a portion different from Embodiment 1 will be described and a portion which is not particularly described is identical to the corresponding portion in Embodiment 1.

In FIG. 18, the cleaning blade supporting member 62*b*, a removed developer accommodating container 44, the drum bearing member (non-driving side) 23 used in Embodiment 1 (FIG. 9) and a drum bearing member (driving side) 72 are shown.

The difference of this embodiment from Embodiment 1 (FIG. 9) is that the removed developer accommodating container 44 is not fixed to the supporting member 62*b* but is fixed to the drum bearing member (driving side) 72 by using the screw 91. As a result, the gaps a1 and b1 at the one end (driving side) are absent but the gaps a2 and b2 at the other end (non-driving side) are provided. For that reason, similarly as in Embodiment 1 (FIG. 9), the cleaning blade fluctuation due to the bimetal which has occurred in the constitution in Comparative Embodiment can be minimized. Further, the fixing portion which has been provided at the longitudinal central portion of the supporting member in Embodiment 1 in order to fix the removed developer accommodating container is eliminated, so that the constitution can be simplified.

As described above, in the cleaning device constituted by the cleaning blade supporting member and the removed developer accommodating container different in thermal expansion coefficient, in the case where the temperature in the operational environment is changed, the expansion and contraction of the supporting member with respect to the longitudinal direction occurs with a different amount every part.

In this embodiment, the removed developer accommodating container and the drum bearing member fixed at the other longitudinal end of the supporting member are not fixed completely among the mutual parts, so that the mutual parts can move in the longitudinal direction of the supporting member. As a result, even when the cleaning device is constituted by the plurality of parts different in thermal expansion coefficient, the expansion and contraction difference with respect to the longitudinal direction of the supporting member due to the temperature change of the respective parts is absorbed and thus deformation such as warpage of the cleaning blade caused by the bimetal can be minimized. That is, the fluctuations in penetration amount and set angle of the cleaning blade with respect to the photosensitive drum due to the bimetal can be minimized, thus leading to stabilization of the cleaning performance.

Further, also with respect to the temperature change in the electrophotographic image forming apparatus, a similar effect can be obtained when the constitution of the present invention is employed.

(Embodiment 7)

Figure 19:
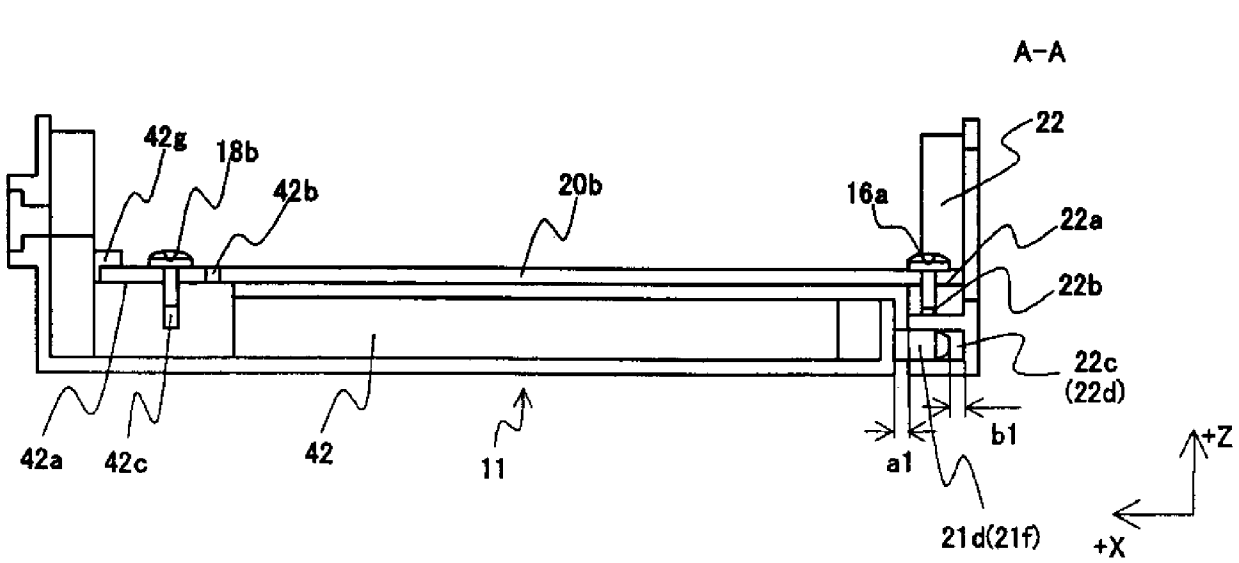

FIG. 19 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to the supporting member 20*b* of the cleaning blade is illustrated. Only a portion different from Embodiment 1 will be described and a portion which is not particularly described is identical to the corresponding portion in Embodiment 1.

In the cleaning device 11 shown in FIG. 19, the removed developer accommodating container 43 and the drum bearing member (non-driving side) 71 in Embodiment 5 (FIG. 17) are integrated with each other and are newly improved and constituted as a removed developer accommodating container 42 also functioning as the drum bearing member (non-driving side). Also in the above constitution, the gaps a1 and b1 are provided and thus there is no change in that the cleaning blade fluctuation due to the bimetal which has occurred in the conventional constitution can be minimized.

Further, the removed developer accommodating container 42 integrally includes the drum bearing member rotatably supporting the one end of the photosensitive drum 7, so that the number of parts can be reduced and thus a reduction in cost can be realized.

(Embodiment 8)

Figure 20:
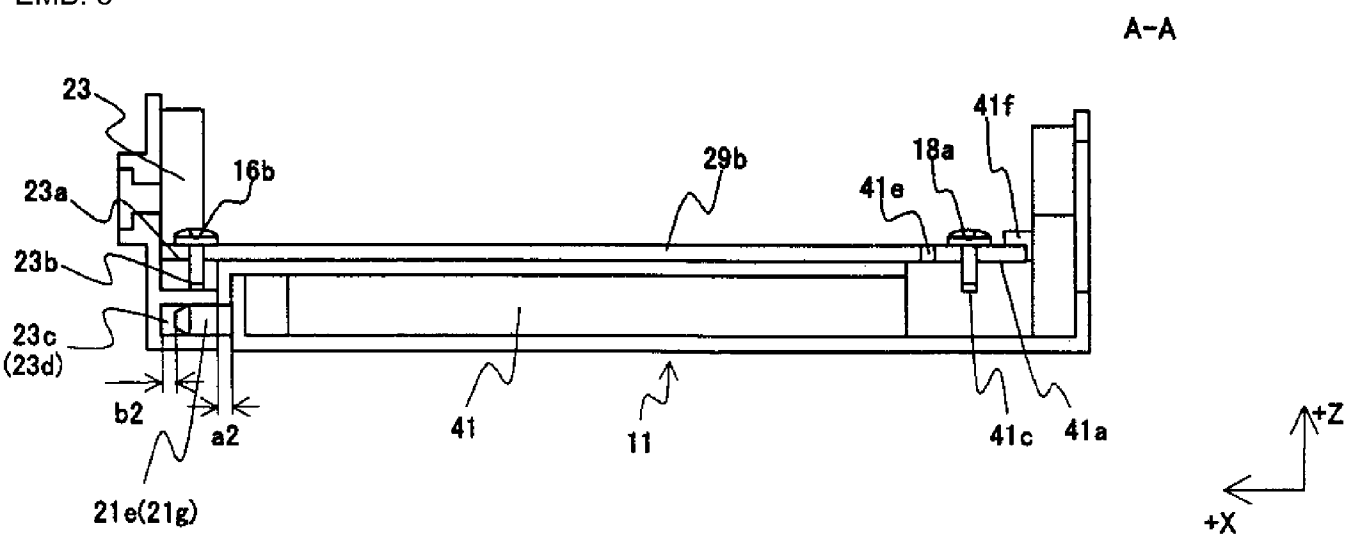

FIG. 20 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to a supporting member 28*b* of the cleaning blade is illustrated. Only a portion different from Embodiment 1 will be described and a portion which is not particularly described is identical to the corresponding portion in Embodiment 1.

As in the cleaning device 11 shown in FIG. 20, even when the constitution at the one end (driving side) and the constitution at the other end (non-driving side) in Embodiment 7 (FIG. 19) are interchanged, a similar effect can be obtained. Further, also with respect to Embodiment 5 (FIG. 17) and Embodiment 6 (FIG. 18), similarly as with respect to Embodiment 7 and Embodiment 8, it is possible to achieve the similar effect even when the constitution at the one end (driving side) and the constitution at the other end (non-driving side) are interchanged.

(Embodiment 9)

Figure 21:
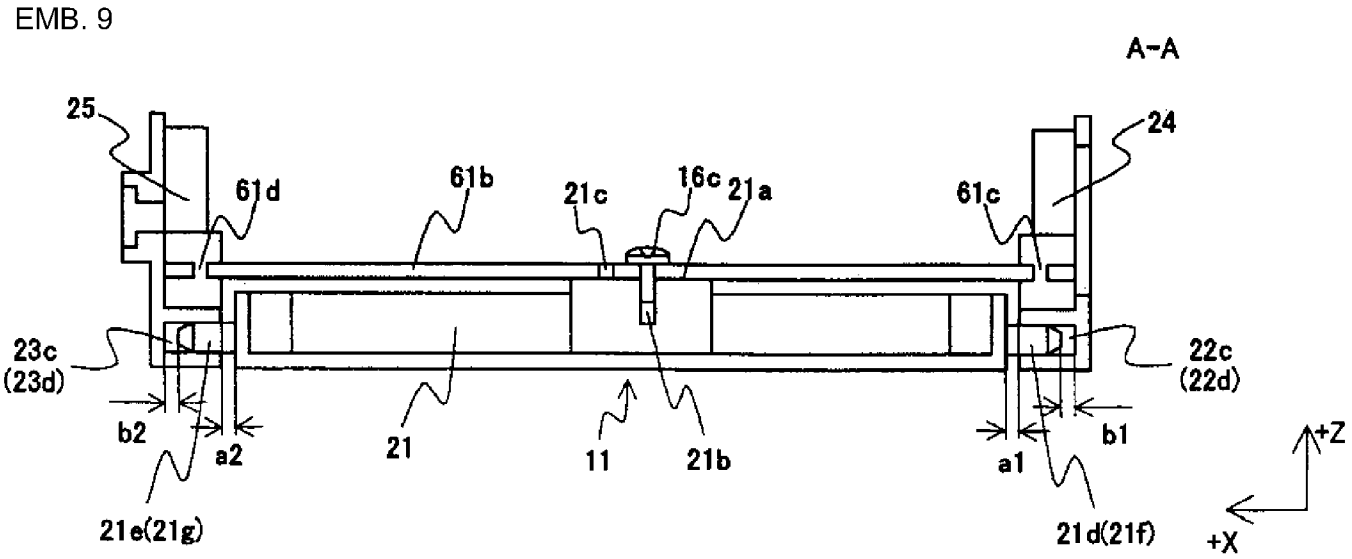

FIG. 21 shows another cleaning device 11 to which the present invention is applicable in another embodiment and is a sectional view showing the same position as that of the cleaning device 11, to which the present invention is applicable, shown in FIG. 9. An A-A sectional front view obtained by cutting the cleaning device 11 in a plane which passes through the center of the axis of the photosensitive drum 7 and is perpendicular to a supporting member 61*b* of the cleaning blade is illustrated. Only a portion different from Embodiment 1 will be described and a portion which is not particularly described is identical to the corresponding portion in Embodiment 1.

Figure 22:
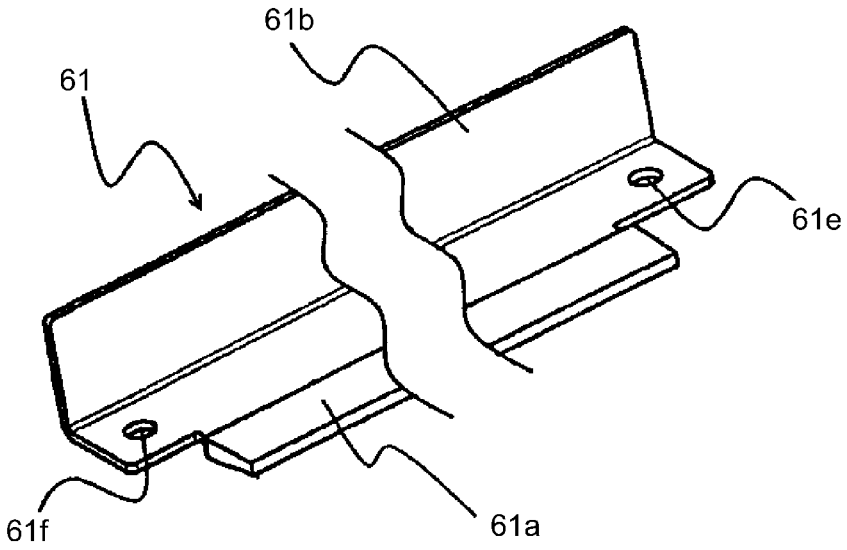
FIG. 22 is a perspective view showing an end lo portion of a supporting member in the cleaning device in Embodiment 9.

In the constitution of Embodiment 1 (FIG. 9), the fixing means for fixing the drum bearing members 22 and 23 to the cleaning blade supporting member 15*b* were the screws. In this embodiment shown in FIG. 21, drum bearing members 24 and 25 are not fixed with the screws but are subjected to outsert molding on the supporting member 61*b*, thus being formed and fixed at the same time. Further, FIG. 22 is a perspective view showing an end portion structure of the supporting member 61*b*, wherein the supporting member 61*b* is provided with holes 61*e* and 61*f*, with respect to the longitudinal direction thereof, in which a molding resin material flows and is positioned so that the molded drum bearing members 24 and 25 are not disconnected.

In this embodiment, at the longitudinal end portions of the supporting member 61*b*, the drum bearing members 24 and 25 are molded by the outsert molding. Thus, the fastening member such as the screw necessary to connect the drum bearing members 24 and 25 with the supporting member 61*b* is not requires, so that the reduction in the number of parts can be realized. As a result, an assembling property is improved to lead to cost reduction.

Further, as shown in FIG. 5, the cleaning edge 61*c* of the elastic blade 61*a* or an edge 61*d* of the supporting member 61*b* is used as a positioning reference for the cleaning blade 61 in a metal mold, and the supporting member 61*b* is set in the metal mold for molding the drum bearing members 24 and 25. Then, the drum bearing members 24 and 25 are subjected to the outsert molding at the both end puritans of the supporting member 61*b*. If the latter positioning method of the cleaning blade 61 is used, it is also possible to connect the elastic blade 61*a* with the supporting member 61*b* after the molding of the drum bearing members 24 and 25.

According to these methods, with respect to dimensional accuracy from the cleaning edge 61*c* which is a cleaning function portion (or the reference edge 61*d* of the supporting member 61*b*) to the center of the photosensitive drum 7 disposed between the drum bearing members 24 and 25, only molding accuracy may be taken into consideration. Thus, the cleaning device can be manufactured in a stable dimension with high precision. As a result, stabilization of the cleaning performance is realized.

On the other hand, in the constitution of Comparative Embodiment, the supporting member 17*b* is fixed to the cleaning container 31 with the fastening member such as the screws 18*a* and 18*b* and therefore there is a need to take into consideration dimensional accuracy of each of parts for the cleaning container 31 and the supporting member 17*b* and variation at the time of the assembling (FIG. 12).

Further, when the drum bearing members 24 and 25 are subjected to the outsert molding at the both end portions of the supporting member 61*b*, the resin material is flowed into the holes of the supporting member 61*b* so as to follow a diesinking shape (shape of the drum bearing members 24 and 25) formed at the longitudinal end portions of the supporting member 61*b* in the metal mold. The flowed resin material is contactable to many surfaces of the supporting member 61*b* with a sufficient contact area and thus connecting stability of mutual parts is improved. As a result, the stability of the cleaning performance can be realized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 058416/2010 filed Mar. 15, 2010, which is hereby incorporated by reference.

What is claimed is:

1. A cleaning device for removing a developer remaining on an image bearing member from the image bearing member, said cleaning device comprising:

cleaning means, including an elastic blade elastically contacted to the image bearing member and a supporting member for supporting said elastic blade, for removing the developer remaining on the image bearing member from the image bearing member;

an image bearing member bearing member including a supporting portion for rotatably supporting the image bearing member; and a removed developer accommodating container formed of a material having a thermal expansion coefficient different from that of a material for said supporting member, said removed developer accommodating container including an accommodating portion for accommodating the developer removed by said cleaning means, wherein said image bearing member bearing member is fixed to said supporting member, wherein said removed developer accommodating container is fixed to said supporting member, and wherein said image bearing member bearing member and said removed developer accommodating container are opposed at their side surfaces to form a gap therebetween with respect to a longitudinal direction of said supporting member.

2. A cleaning device according to claim 1, wherein said image bearing member bearing member is provided at each of longitudinal end portions of the image bearing member, wherein said image bearing member bearing member is fixed at each of longitudinal ends of said supporting member, and wherein said removed developer accommodating container is fixed at a longitudinal central portion of said supporting member.

3. A cleaning device according to claim 1, wherein the gap between said image bearing member bearing member and said removed developer accommodating container is provided at each of longitudinal ends of said supporting member.

4. A cleaning device according to claim 1, wherein said image bearing member bearing member is divided into two separate members fixed at longitudinal ends of said supporting member.

5. A cleaning device according to claim 1, wherein said image bearing member bearing member is fixed at longitudinal ends of said supporting member and includes a connecting portion for connecting said image bearing member bearing member provided at the longitudinal ends.

6. A cleaning device according to claim 1, wherein said image bearing member bearing member is fixed at one longitudinal end of said supporting member, and said removed developer accommodating container is fixed at the other longitudinal end of said supporting member.

7. A cleaning device according to claim 6, wherein said removed developer accommodating container is integrally provided with said image bearing member bearing member which supports at least one end of the image bearing member which is rotatably supported.

8. A cleaning device according to claim 1, wherein in the gap between said image bearing member bearing member and said removed developer accommodating container, rubber is interposed.

9. A cleaning device according to claim 1, wherein in order to position said removed developer accommodating container and said image bearing member bearing member mutually with respect to a widthwise cross-sectional direction of said supporting member, said removed developer accommodating container is provided with an engaging portion and said image bearing member bearing member is provided with a portion to be engaged.

10. A cleaning device according to claim 9, wherein said removed developer accommodating container and said image bearing member bearing member are formed of the same material.

11. A cleaning device according to claim 1, wherein said image bearing member bearing member is formed on said supporting member by outset molding.

12. A cartridge detachably mountable to a main assembly of an image forming apparatus, said cartridge comprising:

a cleaning device according to claim 1.

13. An image forming apparatus comprising:

a cleaning device according to claim 1.

14. A cleaning device for removing a developer remaining on an image bearing member from the image bearing member, said cleaning device comprising:

cleaning means, including an elastic blade elastically contacted to the image bearing member and a supporting member for supporting said elastic blade, for removing the developer remaining on the image bearing member from the image bearing member;

an image bearing member bearing member including a supporting portion for rotatably supporting the image bearing member; and a removed developer accommodating container formed of a material having a thermal expansion coefficient different from that of a material for said supporting member, said removed developer accommodating container including an accommodating portion for accommodating the developer removed by said cleaning means, wherein said image bearing member bearing member is fixed at longitudinal ends of said supporting member, wherein said removed developer accommodating container is fixed to said image bearing member bearing member fixed at one longitudinal end of said supporting member, and wherein said image bearing member bearing member fixed at the other longitudinal end of said supporting member and said removed developer accommodating container are opposed at their side surfaces to form a gap therebetween with respect to a longitudinal direction of said supporting member.

15. A cleaning device according to claim 14, wherein in the gap between said image bearing member bearing member and said removed developer accommodating container, rubber is interposed.

16. A cleaning device according to claim 14, wherein in order to position said removed developer accommodating container and said image bearing member bearing member mutually with respect to a widthwise cross-sectional direction of said supporting member, said removed developer accommodating container is provided with an engaging portion and said image bearing member bearing member is provided with a portion to be engaged.

17. A cleaning device according to claim 16, wherein said removed developer accommodating container and said image bearing member bearing member are formed of the same material.

18. A cleaning device according to claim 14, wherein said image bearing member bearing member is formed on said supporting member by outset molding.

19. A cartridge detachably mountable to a main assembly of an image forming apparatus, said cartridge comprising:

a cleaning device according to claim 14.

20. An image forming apparatus comprising:

a cleaning device according to claim 14.

21. A cleaning device according to claim 1, wherein said removed developer accommodating container includes a positioning pin, and wherein another gap different from the gap is formed between an end of said positioning pin and said image bearing member bearing member.

22. A cleaning device according to claim 14, wherein said removed developer accommodating container includes a positioning pin, and wherein another gap different from the gap is formed between an end of said positioning pin and said image bearing member bearing member.

* * * * *